US010555411B2

(12) United States Patent
Buske et al.

(10) Patent No.: US 10,555,411 B2
(45) Date of Patent: Feb. 4, 2020

(54) DEVICE FOR GENERATING AN ATMOSPHERIC PLASMA BEAM, AND METHOD FOR TREATING THE SURFACE OF A WORKPIECE

(71) Applicant: PlasmaTreat GmbH, Steinhagen (DE)

(72) Inventors: Christian Buske, Bielefeld (DE); Stefan Knipper, Guetersloh (DE)

(73) Assignee: PlasmaTreat GmbH, Steinhagen (DE)

( * ) Notice: Subject to any disclaimer, the term of this patent is extended or adjusted under 35 U.S.C. 154(b) by 0 days.

(21) Appl. No.: 15/781,336

(22) PCT Filed: Dec. 5, 2016

(86) PCT No.: PCT/EP2016/079719

§ 371 (c)(1),
(2) Date: Jun. 4, 2018

(87) PCT Pub. No.: WO2017/097694

PCT Pub. Date: Jun. 15, 2017

(65) Prior Publication Data

US 2018/0359842 A1 Dec. 13, 2018

(30) Foreign Application Priority Data

Dec. 7, 2015 (DE) ..... 10 2015 121 252

(51) Int. Cl.
*H05H 1/34* (2006.01)
*H05H 1/44* (2006.01)

(52) U.S. Cl.
CPC ..... *H05H 1/34* (2013.01); *H05H 1/44* (2013.01); *H05H 2001/3457* (2013.01); *H05H 2001/3463* (2013.01); *H05H 2001/3478* (2013.01)

(58) Field of Classification Search
CPC .. H05H 1/26; H05H 1/32; H05H 1/34; H05H 1/44; H05H 2001/3457; H05H 2001/3463;
(Continued)

(56) References Cited

U.S. PATENT DOCUMENTS 5,728,991 A * 3/1998 Takada ..... B23K 10/02 219/121.45
6,262,386 B1 7/2001 Förnsel
(Continued)

FOREIGN PATENT DOCUMENTS

CN 1777487 A 5/2006
CN 101483968 A 7/2009
(Continued)

*Primary Examiner* — Tu B Hoang
*Assistant Examiner* — Erin E McGrath
(74) *Attorney, Agent, or Firm* — The Webb Law Firm

(57) ABSTRACT

A device for generating an atmospheric plasma beam for treating the surface of a workpiece includes a tubular housing with an axis, an inner electrode within the housing, and a nozzle assembly with a nozzle opening for discharging a plasma beam to be generated in the housing. The direction of the nozzle opening runs at an angle relative to the axis, and the nozzle assembly can be rotated about the axis. By the aforementioned device, disadvantages are at least partly eliminated and uniform treatment of the surface is achieved in that a shield surrounds the nozzle assembly, and the shield is designed to change the intensity of the interaction of the plasma beam to be generated with the surface of the workpiece depending on the rotational angle of the nozzle assembly relative to the axis. Also provided are a system and method for treating the surface of a workpiece.

11 Claims, 20 Drawing Sheets

(58) Field of Classification Search
CPC .... H05H 2001/3478; B23K 10/00–027; B23K 9/295; B23K 9/296
USPC ..... 219/121.36, 37, 39, 4, 45, 47, 48, 49, 5, 219/51, 52, 53, 54, 56, 57, 58; 313/231.31, 41, 51, 61
See application file for complete search history.

(56) References Cited

U.S. PATENT DOCUMENTS

| | | | | |
|---|---|---|---|---|
| 6,265,690 | B1 | 7/2001 | Fornsel | |
| 8,381,678 | B2 | 2/2013 | Tsai et al. | |
| 2002/0179575 | A1* | 12/2002 | Fornsel | H05H 1/34 219/121.5 |
| 2004/0169018 | A1* | 9/2004 | Brasseur | B23K 10/00 219/121.5 |
| 2006/0172081 | A1 | 8/2006 | Flinn et al. | |
| 2007/0181540 | A1* | 8/2007 | Lindsay | B23K 10/00 219/121.5 |
| 2010/0096086 | A1 | 4/2010 | Minkow et al. | |
| 2013/0199540 | A1 | 8/2013 | Buske | |
| 2014/0034618 | A1 | 2/2014 | Twarog | |
| 2015/0079309 | A1 | 3/2015 | Krueger et al. | |
| 2015/0303034 | A1 | 10/2015 | Hsu et al. | |
| 2016/0314938 | A1 | 10/2016 | Park | |

FOREIGN PATENT DOCUMENTS

| | | | |
|---|---|---|---|
| CN | 101631416 | A | 1/2010 |
| CN | 102481657 | A | 5/2012 |
| CN | 104704926 | A | 6/2015 |
| CN | 105025647 | A | 11/2015 |
| CN | 205160896 | U | 4/2016 |
| CN | 105830540 | A | 8/2016 |
| DE | 3612722 | A1 | 10/1987 |
| DE | 202007018327 | U1 | 8/2008 |
| DE | 102010011643 | A1 | 9/2011 |
| DE | 102012206081 | A1 | 10/2013 |
| EP | 1067829 | B1 | 5/2006 |
| JP | S62166080 | A | 7/1987 |
| JP | 2010097931 | A | 4/2010 |
| WO | 9952333 | A1 | 10/1999 |
| WO | 2006136467 | A1 | 12/2006 |
| WO | 2015088069 | A1 | 6/2015 |

* cited by examiner

DEVICE FOR GENERATING AN ATMOSPHERIC PLASMA BEAM, AND METHOD FOR TREATING THE SURFACE OF A WORKPIECE

CROSS-REFERENCE TO RELATED APPLICATIONS

This application is the United States national phase of International Application No. PCT/EP2016/079719 filed Dec. 5, 2016, and claims priority to German Patent Application No. 10 2015 121 252.8 filed Dec. 7, 2015, the disclosures of which are hereby incorporated in their entirety by reference.

BACKGROUND OF THE INVENTION

Field of the Invention

The invention relates to a device for generating an atmospheric plasma beam for treating the surface of a workpiece having a plasma beam which rotates about an axis and produces a wide treatment path when moving over the surface. The invention also relates to an apparatus having at least one plasma device which rotates about an axis and in this process generates at least one plasma beam in a circular movement over the surface. A wide treatment path is also produced when the at least one plasma beam moves over the surface. In addition, the invention relates to a method for treating the surface of a workpiece using such a device or such an arrangement.

Description of Related Art

Within the scope of this description, a treatment of a surface with a plasma beam is in particular understood to encompass a surface pretreatment, by means of which the surface tension is altered and a better wettability of the surface with fluids is obtained. A treatment of the surface can also be understood as a surface coating, in which by adding at least one precursor to the plasma beam a surface coating is obtained by a chemical reaction which takes place in the plasma beam and/or on the surface of the workpiece, wherein at least a part of the chemical products is deposited. In addition, a surface treatment can also mean cleaning, disinfection or sterilisation of the surface.

A device for generating an atmospheric plasma beam for treating the surface of a workpiece having a plasma beam rotating about an axis is known from EP 1 067 829 B1. This device has on a tubular housing, which has an axis A, an inner electrode which is arranged within the housing and which preferably runs parallel to the axis A or which in particular is arranged in the axis A. During operation of the device, an electric voltage is applied to the inner electrode by means of which voltage an electric discharge occurs which by interaction with the working gas flowing within the housing generates a plasma. The plasma together with the working gas is transported further.

In addition, the device has a nozzle arrangement having a nozzle opening for discharging a plasma beam to be generated in the housing, wherein the nozzle arrangement is preferably arranged at the end of the discharge path, is earthed and channels the emanating gas and plasma beam. The direction of the nozzle opening runs at an angle relative to the axis A, wherein the direction of the nozzle opening can be assumed parallel to the central direction of the emanating plasma beam and can be defined, for example, parallel to the normal of the opening. For this purpose, a channel runs in the shape of an arc within the nozzle arrangement, in order to divert the gas and plasma beam starting from inside the housing. Finally, the nozzle arrangement is rotatable relatively about the axis A, wherein the nozzle arrangement is either rotatable with respect to the housing and the inner electrode or is connected to the housing in a torque proof manner while the housing rotates relative to the inner electrode. The nozzle arrangement or the nozzle arrangement and the housing are driven by a motor for the rotational movement.

An apparatus for treating a surface with atmospheric plasma is known from EP 0 986 939 B1 and has two devices for generating an atmospheric plasma beam, wherein each of the two devices has a tubular housing, which has an axis A or A', respectively, an inner electrode arranged within the housing and a nozzle arrangement having a nozzle opening for discharging a plasma beam to be generated in the housing, wherein the two devices are connected together rotatable about a common axis B, and wherein a drive is provided for generating a rotational movement of the devices about the axis (B).

Using the two previously described devices or apparatuses, it is possible to produce a relatively wide treatment path by moving the rotating plasma beams along the surface of the workpiece to be processed. Therefore, these techniques are used a great deal.

Even if a plurality of paths of plasma treatment of the surface parallel and partly overlapping result in larger areas being able to be plasma treated, differences in the intensity of the plasma treatment on the surface occur transverse to the direction of movement of the device or apparatus. This effect is explained in more detail with the aid of FIG. 1.

The treatment path of a plasma beam of an above described device is illustrated in FIG. 1*a*, wherein the trajectory (line) represents the point of impact of the maximum plasma intensity. The device is moved in the y direction i.e. upwards in FIG. 1, in order to apply the rotating plasma beam continuously over a strip with an approximate width dx and treat the surface with plasma. The direction of movement (y) causes the outer areas of the treatment path (dx) to be more intensively treated with the plasma in the area of the dashed lines than is the case for the middle areas of the treatment path.

This results in the intensity distribution illustrated in FIG. 1*b*, which has two maxima which occur in the outer areas of the treatment path, indicated by the dashed lines. In between, only a distinctly low intensity of plasma treatment takes place, so that a minimum intensity occurs in the middle of the treatment path.

For this reason, the surface is but inadequately plasma treated and moreover insufficiently plasma treated in regular strips. Therefore, the speed of movement of the device relative to the surface has to be regularly slowed down, so that saturation of the plasma treatment is also achieved in the middle areas of the treatment path. The application of the device is as a consequence constrained.

SUMMARY OF THE INVENTION

Therefore, the invention is based on the technical problem of further developing the device and apparatus mentioned at the outset as well as the method for treating the surface of a workpiece such that the disadvantages mentioned are at least partly eliminated and such that a more uniform treatment of the surface is obtained.

The previously disclosed technical problem is firstly solved according to the invention with a device for generating an atmospheric plasma beam for treating the surface of a workpiece of the type mentioned at the outset in that a shield surrounds the nozzle arrangement and in that the shield is provided for changing the intensity of the interaction of the plasma beam to be generated with the surface of the workpiece depending on the angle of rotation of the nozzle relative to the axis A.

The function of the described shield is to influence the rotating plasma beam depending on the angular position such that the intensity of the plasma beam on the surface of the workpiece has an azimuthally varying distribution. The intensity of the plasma treatment generally depends, with otherwise constant conditions, on the duration of the application, on the distance of the surface from the nozzle opening and/or on the angle of impact of the plasma beam on the surface. If the shield now influences one or more of these parameters in an azimuthally varying way, then the intensity of the plasma treatment of the surface can have an azimuthal distribution.

In a first preferred embodiment, the device is characterised in that the shield is only formed over a partial section in the azimuthal direction. By the shield only being partially present, the plasma beam is only shielded, i.e. influenced, over a part of a rotation and not or only slightly influenced over a wider part of the rotation. In this way, an azimuthal intensity distribution can be set by the design of the shield itself.

Preferably, the previously explained shield is formed over two partial sections in the azimuthal direction symmetrically to the axis A. In this way, a symmetrical intensity distribution of a plasma treatment can be obtained which can be advantageously set in particular by moving the device relative to the surface.

In a further embodiment of the outlined shield, the axial length of the shield varies in the azimuthal direction. Thus, the shield protrudes at different lengths in the axial direction and influences the plasma beam varyingly strongly depending on the length. In the sections in which the length is maximum, the obliquely striking plasma beam is at least partly reflected by the inside of the shield and therefore deflected inwards. Thus, the intensity of the plasma treatment is changed there by the deflection of the plasma beam and the plasma treatment is intensified in the inner area of the shield or in the inner area of the spatial area surrounded by the rotating plasma beam, respectively.

In addition, the length of the shield can vary in steps. In this case, the shield has an effect on the striking plasma beam over a first section with the full length and does not have or only slightly has an effect over a second section because in the second section the shield is formed shorter. In a symmetrical design, for example two identically long first sections and two identically short second sections of the shield are then provided.

An embodiment in steps results in an abrupt change in the plasma intensity in the azimuthal direction which is particularly suitable with static applications for producing a specific pattern on the surface.

In addition, the length of the shield can vary constantly, in particular in the form of a sine function. This embodiment has the advantage that the shield and hence the change in the intensity of the plasma treatment in the azimuthal direction can be varied not abruptly in steps, but rather in the form of a constantly changing function. The distribution of the plasma intensity which arises as a consequence then results in a more uniform treatment of the surface of the workpiece during a movement of the device relative to a surface.

A further embodiment of the device according to the invention consists in the inner surface of the shield adopting azimuthally varying angles relative to the axis A. In this way, the degree of deflection of the plasma beam can be azimuthally altered by the shield. Thus, the inner surface of the shield can, for example, at one place adopt an angle of 90° in relation to the surface to be treated, while at another place, possibly offset by a rotation of 90° to that, the inner surface is inclined outwardly at an angle of 70°. The change in the angle of the inner surface can also be varied in steps or constantly here.

Therefore, a shield design which is symmetrical in the azimuthal direction can also be obtained, in which for example at 0° and 180° in the direction of movement of the device over the surface the inner surface of the shield has an angle of 90°, while at 90° and 270° there is an angle of the inner surface of 70°.

In principle, the angle of the inner surface can be directed both inwardly and outwardly. Thus, a stronger or less strong deflection of the plasma beam can be chosen depending on the application.

The azimuthal change in the angle of the inner surface of the shield can incidentally also be combined with a previously described azimuthal variation in the length of the shield in the axial direction.

A further preferred embodiment of the described device for generating an atmospheric plasma beam for treating the surface of a workpiece has a shield which is designed to be adjustable in its position relative to the nozzle arrangement, in particular in the direction of the axis A and/or in the radial direction.

Therefore, for example, the entire shield can be designed to be moveable in the axial direction. The strength and also the azimuthal range of effect of the shield can be set in this way. The further the lower edge of the shield is positioned away from the nozzle arrangement, the more strongly the emanating plasma beam is deflected and influenced. Equally, with a constantly varying length of the shield, the section of the shield influencing the plasma beam has an effect over a greater azimuthal range. If, on the other hand, the lower edge of the shield is arranged less far away from the nozzle arrangement, then the strength of the interaction and as appropriate the azimuthal range of effect of the shield is lower.

In addition, the shield can have at least two, preferably several, shield elements which are designed to be adjustable independently of one another. The shield elements can be adjusted in the radial direction and/or in the axial direction. A greater variability in setting the azimuthal intensity distribution of the plasma beam is possible by means of this embodiment. If each shield element can be set individually in its position, then the azimuthal distribution can also be set individually. The device can therefore be set more variably, in particular in the case of special applications.

In addition—independent of the azimuthal variation of the previously described shield—a heating device can be provided for heating the shield. This heating has the advantage that the plasma beam striking the shield transfers thermal energy to the shield to a lesser extent and hence functions more free of loss. Where required, the shield can be heated to a temperature which is higher than the temperature of the plasma beam, so that the plasma beam can be further supplied with thermal energy by the shield.

A heating device can be formed as a thermal radiator in the form of an outer heating jacket or by electric heating integrated into the shield.

In any case, the heating device can also be used in rotationally symmetrical shields.

The above disclosed technical problem is also solved by a method for treating the surface of a workpiece, in which a plasma beam rotating about the axis A is generated by means of a device generating an atmospheric plasma beam, the device having an axis A and having a nozzle arrangement rotating relatively about the axis A, in which the device with the rotating plasma beam is moved along the surface to be treated, and in which the intensity of the interaction of the plasma beam with the surface of the workpiece is changed depending on the angle of rotation of the nozzle relative to the axis A by means of a shield.

By azimuthally changing the intensity of the plasma beam, the uniformity of the effect of the plasma beam relative to the direction of movement over the surface can be improved when the device generates a treatment path.

In particular if the rotating plasma beam is shielded more strongly by the shield longitudinally to the direction of movement than transverse to the direction of movement, in particular is reflected or deflected inwards, respectively, a more uniform plasma treatment is obtained along the treatment path. This is illustrated by the intensity profile in FIG. 1*c*, which in contrast to FIG. 1*b*, adopts a flat or only slightly wavy form of a plateau. If then, adjacent treatment paths are brought onto the surface overlapping such that in the overlapping areas added together the intensity of the plateau is achieved, then the surface as a whole is more uniformly treated by the plasma beam than has been possible up to now in the prior art.

The shield can be designed according to the different embodiments previously described for the device when carrying out the method without them having to be explained again here. The same described advantages result.

The above disclosed technical problem is also solved by an apparatus for treating a surface with atmospheric plasma having at least one device for generating an atmospheric plasma beam, wherein the at least one device has a tubular housing which has an axis A or A', respectively, an inner electrode arranged within the housing and a nozzle arrangement which has a nozzle opening for discharging a plasma beam to be generated in the housing, wherein the at least one device is rotatable about a, possibly common, axis B, and wherein a drive is provided for generating a rotational movement of the at least one device about the axis B. The apparatus is characterised in that the direction of the nozzle opening of the at least one device runs at an angle relative to the axis A or A', respectively, in that the nozzle arrangement of the at least one device can be rotated relatively about the axis A or A', respectively, in that in each case a drive is provided for generating a rotational movement of the nozzle arrangement of the at least one device about the respective axis A or A', respectively, in that the at least one device is aligned at an angle relative to the axis B, and in that the drive for generating a rotational movement of the at least one device and the drive for generating a rotational movement of the nozzle arrangement of the at least one device are synchronised together in such a way that during one rotation of the at least one device about the common axis B the nozzle arrangement of the at least one device performs two rotations about the respective axis A or A', respectively.

Previously, the apparatus in general was described with at least one device. An apparatus with two devices is preferred, wherein apparatuses with three or more devices are also possible. Below, the invention is preferentially described by means of an apparatus having two devices, but that is not to limit the invention to two devices.

According to the preferred embodiment of the apparatus with two devices, during a rotation of the two devices about the common axis B each of the two plasma beams has a first angle twice, in particular a steep angle, preferably an angle of 90° relative to the surface of the workpiece, and a second angle twice, in particular a maximally flat angle of, for example, 70° relative to the surface. In the angles adopted in between of the two devices relative to the axis B the plasma beam angle lies between the two extreme values. Hence, due to the different plasma beam angles and additionally as a result of the associated greater distance of the nozzle arrangements from the surface of the workpiece, the intensity of the plasma treatment on the surface varies in the azimuthal direction.

In a preferred embodiment, the angle of the nozzle openings relative to the respective axis A or A', respectively, essentially coincides with the angle of the devices relative to the axis B. Thus, in two angular positions of the devices relative to the axis B a perpendicular alignment of the respective plasma beam is obtained.

In a further preferred manner, the rotational movement of the nozzle arrangements is transferred via a planetary gear by the rotational movement of the devices about the axis B. A synchronous movement is thereby achieved in a purely mechanical manner. Equally, a synchronous electronic control of individual motors is possible without then requiring a planetary gear.

In addition, the above disclosed technical problem is solved by a method for treating the surface of a workpiece, in which at least one rotating plasma beam is generated by means of a previously described apparatus, in which the apparatus with the at least one rotating plasma beam is moved along the surface to be treated, and in which the at least one plasma beam is directed in two first angular positions of 0° or 180°, respectively, of the rotational movement about the axis B at a steep, preferably perpendicular, angle onto the surface of the workpiece, and in which the at least one plasma beam is directed in two second angular positions of 90° or 270°, respectively of the rotational movement about the axis B at a flat angle, preferably at an angle which is double the angle of the nozzle openings relative to the axes A or A', respectively, onto the surface of the workpiece.

Preferably, the apparatus is essentially moved in the direction of one of the two first angular positions 0° or 180°, respectively, of the rotational movement about the axis B along the surface.

Thus, the plasma treatment is weakened in the angle positions 90° or 270°, respectively, by the oblique position of the at least one plasma beam, preferably of the two plasma beams, and the associated greater distance of the nozzle openings from the surface, while the plasma treatment is maximally set in the direction of movement at 0° or 180°, respectively, since the at least one plasma beam strikes the surface at a steep angle here and there is also a shorter distance between the nozzle opening and the surface to be treated.

Preferably, the method is carried out using an apparatus having two devices.

A distinctly more uniform treatment of the surface is also obtained with this method, as has already been explained above with the aid of FIG. 1*c*. The explanations and advantages there also apply for the method described here.

BRIEF DESCRIPTION OF THE DRAWINGS

The invention is explained in more detail below by means of exemplary embodiments with reference to the figures.

DESCRIPTION OF THE INVENTION

In the following description of the different exemplary embodiments according to the invention, the same components are provided with the same reference symbols, even though the components in the different exemplary embodiments can have differences in size and shape.

Figure 2:
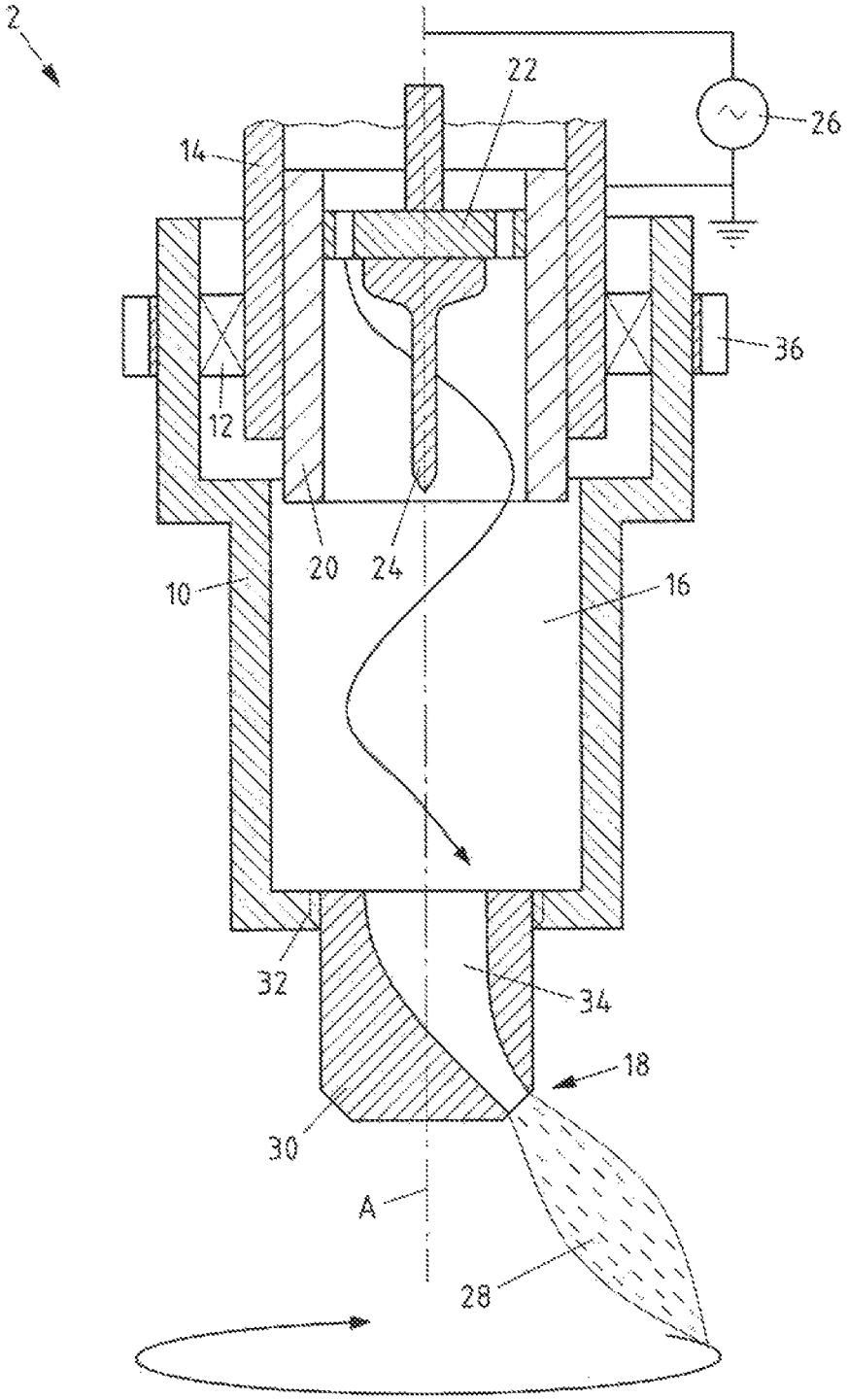
Fig.2 PRIOR ART
FIG. 2 shows a device known from the prior art for generating a plasma beam.

Before examining a first exemplary embodiment, a plasma nozzle arrangement forming the basis of the present invention should be explained with the aid of FIG. 2.

The device 2 shown in FIG. 2 and known from EP 1 067 829 B1 for generating a plasma beam has a tubular housing 10 which in its upper area in the figure is widened in diameter and is mounted rotatably on a fixed supporting tube 14 by means of a bearing 12. A nozzle channel 16 is formed inside the housing 10 and leads from the open end of the supporting tube 14 to a nozzle opening 18.

An electrically insulating ceramic tube 20 is inserted into the supporting tube 14. A working gas, for example air, is fed through the supporting tube 14 and the ceramic tube 20 into the nozzle channel 16. The working gas is swirled by a swirl device 22, which is inserted into the ceramic tube 20, such that it flows in a vortex-like manner through the nozzle channel 16 to the nozzle opening 18, as is symbolised in the figure by a screw-like arrow. Thus, a vortex core is formed in the nozzle channel 16 and runs longitudinally to the axis A of the housing 10.

A pin-shaped inner electrode 24 is mounted on the swirl device 22, which protrudes coaxially into the nozzle channel 16 and to which a high-frequency high voltage is applied by means of a high-voltage generator 26. A high-frequency high voltage is typically understood as a voltage of 1 to 100 kV, in particular 1 to 50 kV, preferably 5 to 50 kV, at a frequency of 1 to 100 kHz, in particular 10 to 100 kHz, preferably 10 to 50 kHz. The high-frequency high voltage can be a high-frequency alternating voltage, but it can also be a pulsed direct voltage or an overlay of both voltage forms.

The housing 10 consisting of metal is earthed via the bearing 12 and the supporting tube 14 and serves a counter electrode, so that an electric discharge can be produced between the inner electrode 24 and the housing 10.

The inner electrode 24 arranged inside the housing 10 is preferably aligned parallel to the axis A, in particular the inner electrode 24 is arranged in the axis A.

The nozzle opening 18 of the nozzle channel is formed by a nozzle arrangement 30 consisting of metal which is screwed into a threaded hole 32 of the housing 10 and in which a channel 34 is formed which is tapered and curved towards the nozzle opening 18 and runs obliquely in relation to the axis A. In this way, the plasma beam 28 emanating from the nozzle opening 18 forms an angle with the axis A of the housing, which in the example shown is approximately 45°. This angle can be varied as required by changing the nozzle arrangement 30.

The nozzle arrangement 30 is hence arranged at the end of the discharge path of the high-frequency arc discharge and is earthed via the metallic contact with the housing 10. The nozzle arrangement 30 thus channels the emanating gas and plasma beam, wherein the direction of the nozzle opening 18 runs at a prespecified angle relative to the axis A. The direction of the nozzle opening 18 can be defined parallel to the normal of the nozzle opening 18.

Since the nozzle arrangement 30 is connected to the housing 10 in a torque-proof manner and since the housing 10 is, on the other hand, rotatably attached with respect to the supporting tube 14 via the bearing 12, the nozzle arrangement 30 can rotate relatively about the axis A. A toothed wheel 36 is arranged on the widened upper part of the housing 10 and is in drive connection with a motor (not shown) via a toothed belt or a pinion.

During operation of the device 2 through the high-frequency high voltage an arc discharge is produced between the inner electrode 24 and the housing 10 due to the high frequency of the voltage. The electric arc of this high-frequency arc discharge is carried along by the swirled inflowing working gas and channelled in the core of the vortex-like gas flow, so that the electric arc then runs almost rectilinearly from the tip of the inner electrode 24 longitudinally to the axis A and only branches in the area of the lower end of the housing 10 or in the area of the channel 34 radially to the housing wall or to the wall of the nozzle arrangement 30. In this way, a plasma beam 28 is generated which discharges through the nozzle opening 18.

The terms "electric arc" or "arc discharge" are in the present case used as a phenomenological description of the discharge, since the discharge occurs in the form of an electric arc. The term "electric arc" is otherwise also used as a discharge form in direct voltage discharges with essentially constant voltage values. In the present case, however, it is a high-voltage discharge in the form of an electric arc, i.e. a high-frequency arc discharge.

In operation the housing 10 rotates with a high speed of rotation about the axis A, so that the plasma beam 28 describes a lateral surface of a cone which brushes over the surface of a workpiece (not shown) to be processed. If then the device 2 is moved along on the surface of the workpiece or inversely the workpiece is moved along on the device 2, then a relatively uniform treatment of the surface of the workpiece is obtained on a strip, the width of which corresponds to the diameter of the cone on the workpiece surface described by the plasma beam 28. By varying the distance between the mouthpiece 30 and the workpiece, the width of the area of the pre-treated area can be influenced. By means of the plasma beam 28, which for its part is swirled, striking the workpiece surface obliquely, an intensive effect on the workpiece surface is achieved by the plasma. The swirl direction of the plasma beam can be in the same direction or in the opposite direction to the rotational direction of the housing 10.

The intensity of the plasma treatment by the rotating plasma beam 28 is dependent on the distance of the nozzle opening 18 from the surface, on the one hand, and on the angle of impact of the plasma beam 28 on the surface to be treated, on the other hand.

Figures 1A, 1B, 1C:
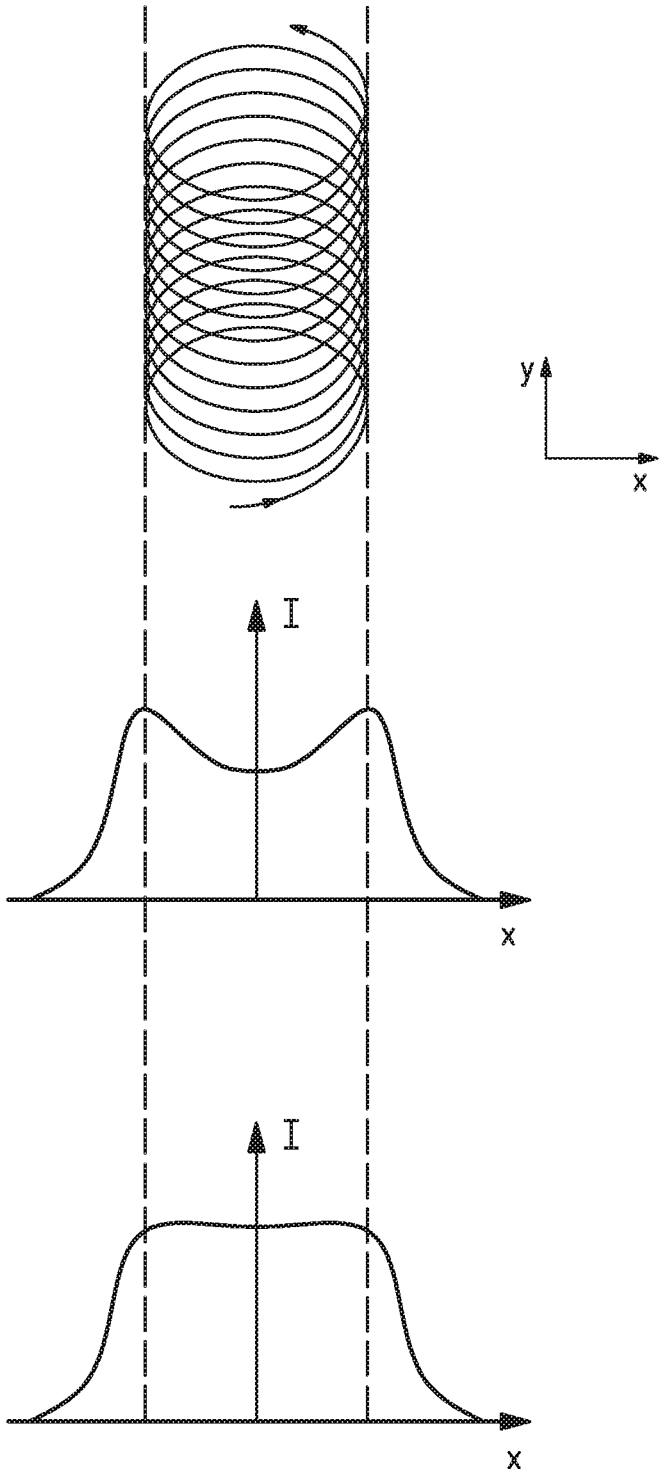
Fig.1a Prior Art
Fig.1b Prior Art
FIGS. 1*a-c* show graphical illustrations for explaining the principle of operation in the prior art and according to the present invention.
Figure 3A:
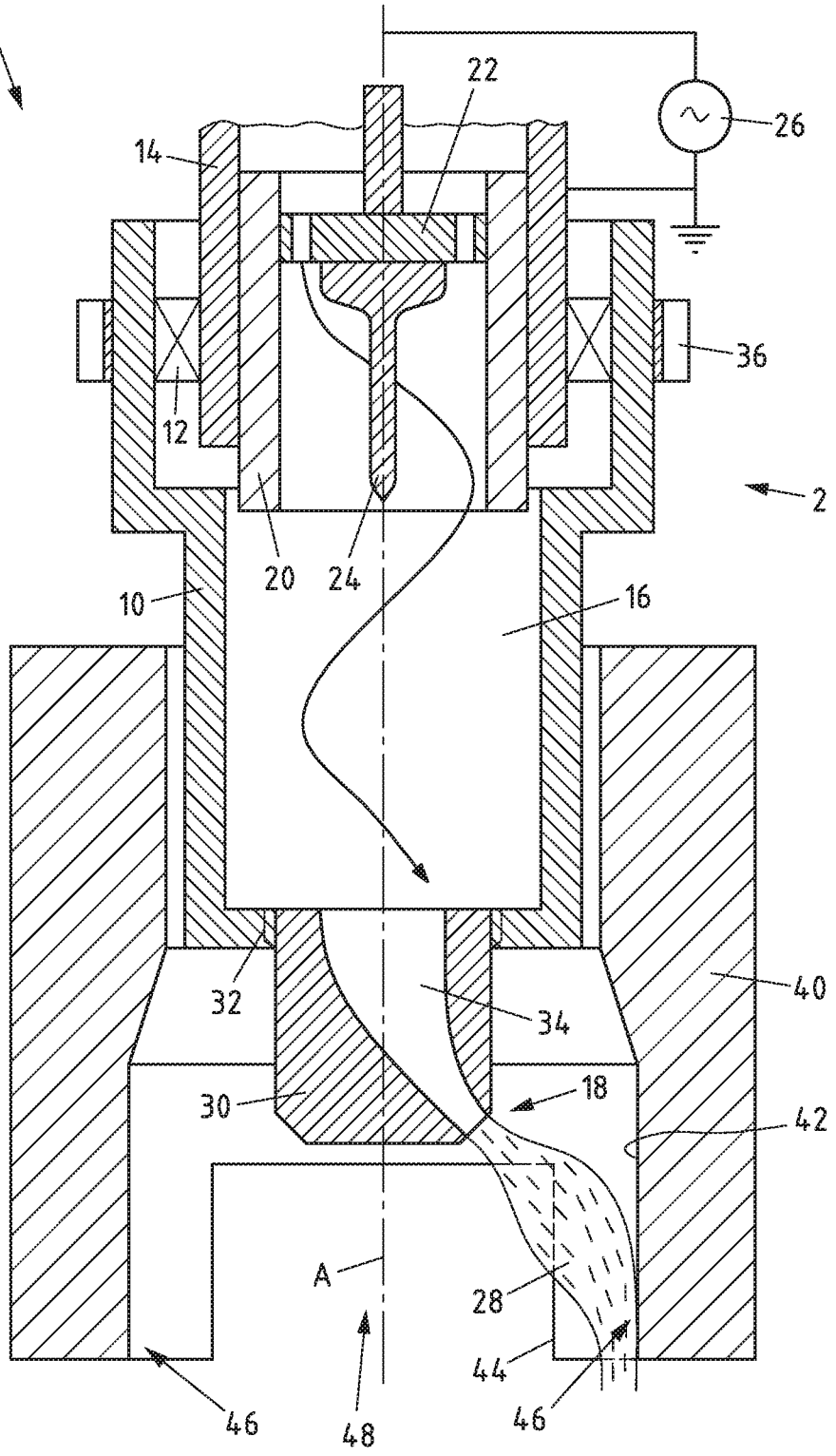
FIGS. 3*a-c* show a first exemplary embodiment of a device according to the invention for generating a plasma beam.
Figure 3B:
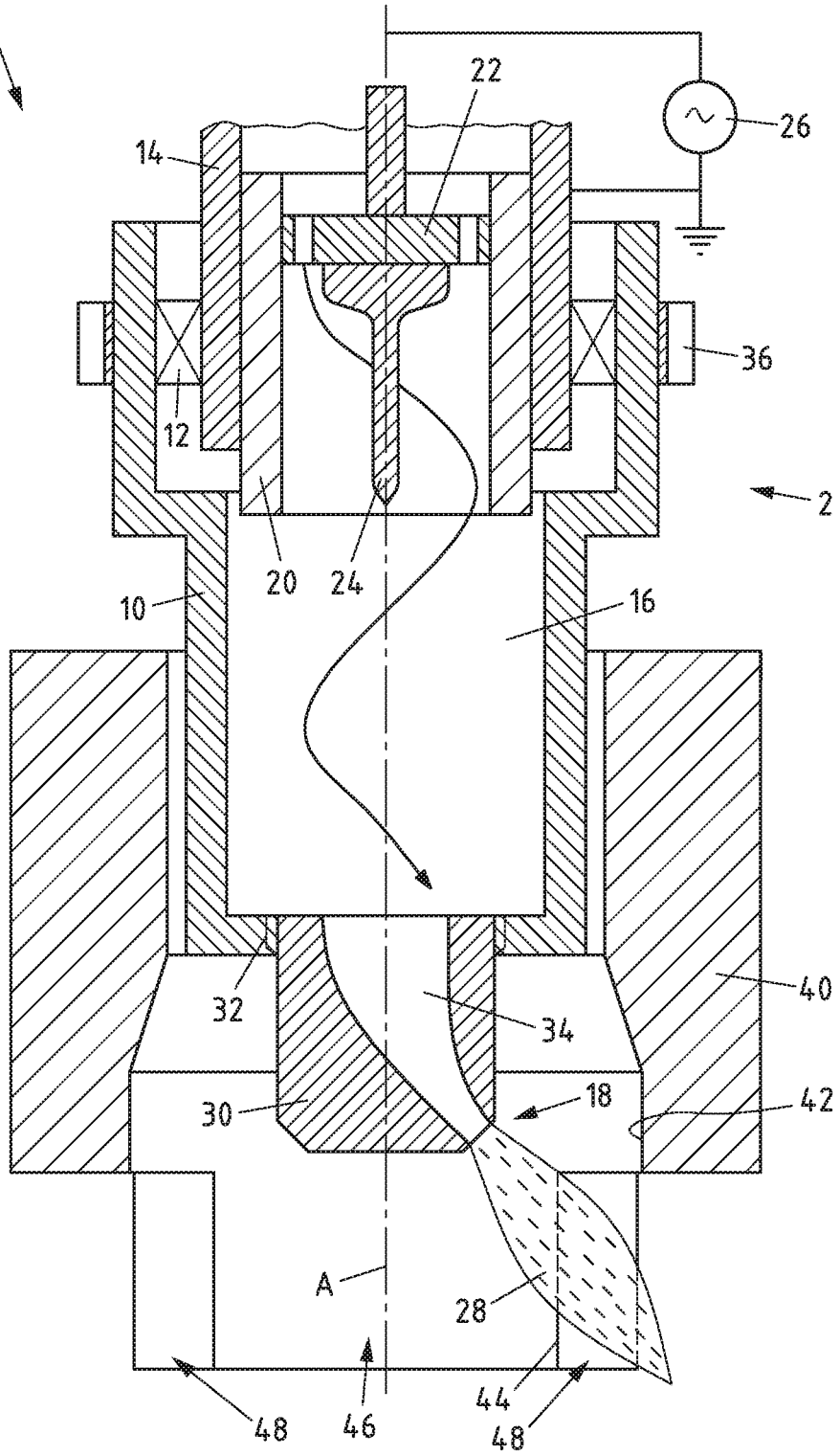
Figure 3C:
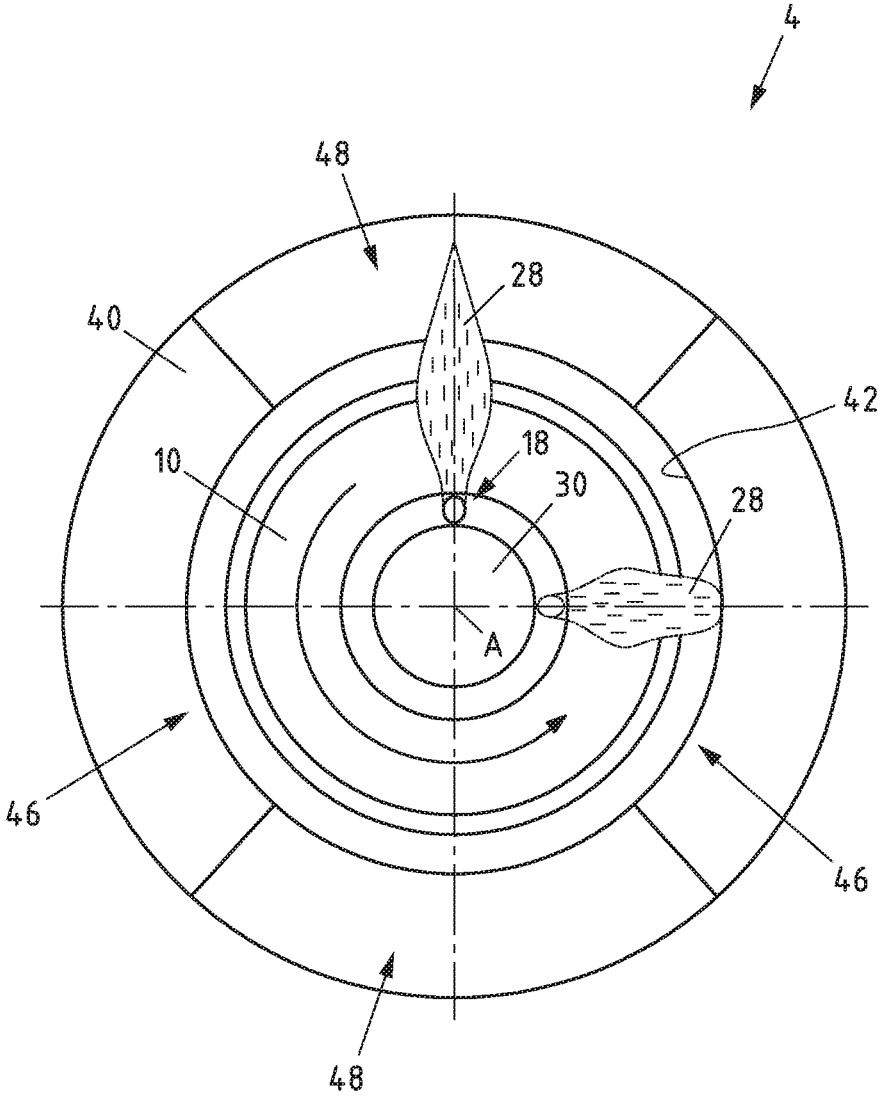

FIGS. 3*a* to 3*c* show a first exemplary embodiment of a device 4 according to the invention having a device 2 which has the same design as what was previously described with the aid of FIG. 1. According to the invention, a shield 40 is provided which surrounds the nozzle arrangement 30. The form of the shield 40 has a cylindrical inner surface 42 in the section projecting downwards beyond the lower edge of the nozzle arrangement 30, this cylindrical inner surface 42 in sections having steps 44. Thus, the shield 40 in the azimuthal direction forms sections 46 with a greater axial length and sections 48 with a smaller axial length. Hence, the shield 40 changes the intensity of the interaction of the plasma beam 28 with the surface of the workpiece depending on the angle of rotation of the nozzle arrangement 30 relative to the axis A.

As shown in FIG. 3*a*, the plasma beam 28 strikes one of the longer sections 46 of the shield 40, so that the plasma beam 28 is deflected or reflected inwards, respectively. FIG. 3*b* shows the lower section of the device 4 according to the invention in a position rotated by 90° compared to the one illustrated in FIG. 3*a*. Here, the plasma beam 28 is directed onto one of the shortened sections 48 and can almost emanate from the nozzle arrangement 30 without any interaction with the shield. The shield 40 or the arrangement of the sections 46 and 48 is formed symmetrically to the axis A in the azimuthal direction.

The design of the shield can also be recognised in FIG. 3*c* in a view of the device 2 from below. The different illustrated forms of the plasma beam 28 are intended to make clear that the plasma beam 28 depending on the angle of the inner surface 42 is influenced more strongly in the area of the longer section 46 than is the case in the area of the shorter section 48. Hence, the result is an intensity of the interaction of the plasma beam 28 with the surface of the workpiece which varies in the azimuthal direction.

As illustrated in FIGS. 3*a* to 3*c*, the shield 40 is formed such that it surrounds the nozzle arrangement 30 over the entire circumference, wherein two shorter sections 46 and two longer sections 48 are provided in each case. An embodiment in which the shield is only formed over one section or two sections in the azimuthal direction is not illustrated in FIG. 3.

Figure 4A:
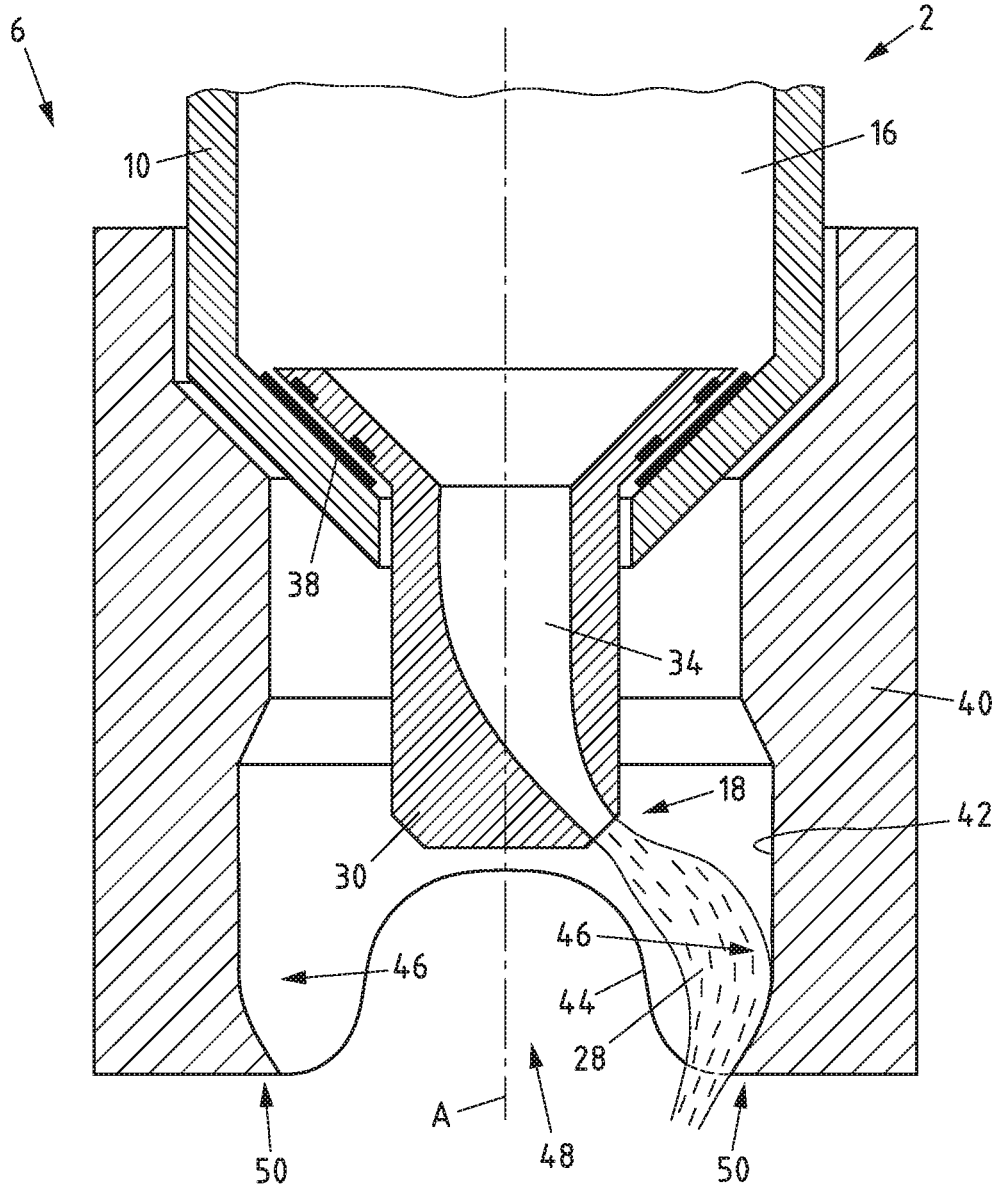
FIGS. 4*a-c* show a second exemplary embodiment of a device according to the invention for generating a plasma beam.
Figure 4B:
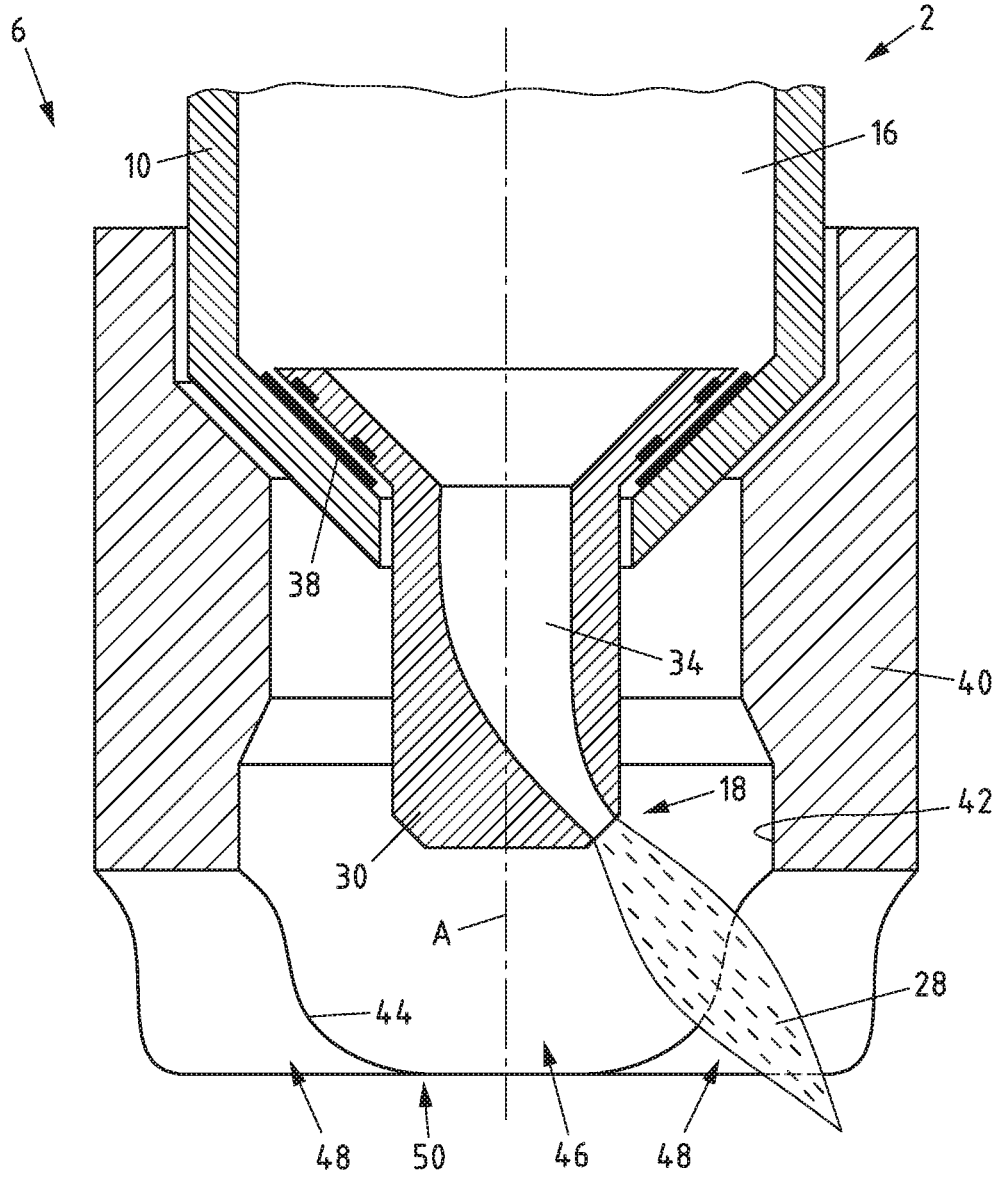
Figure 4C:
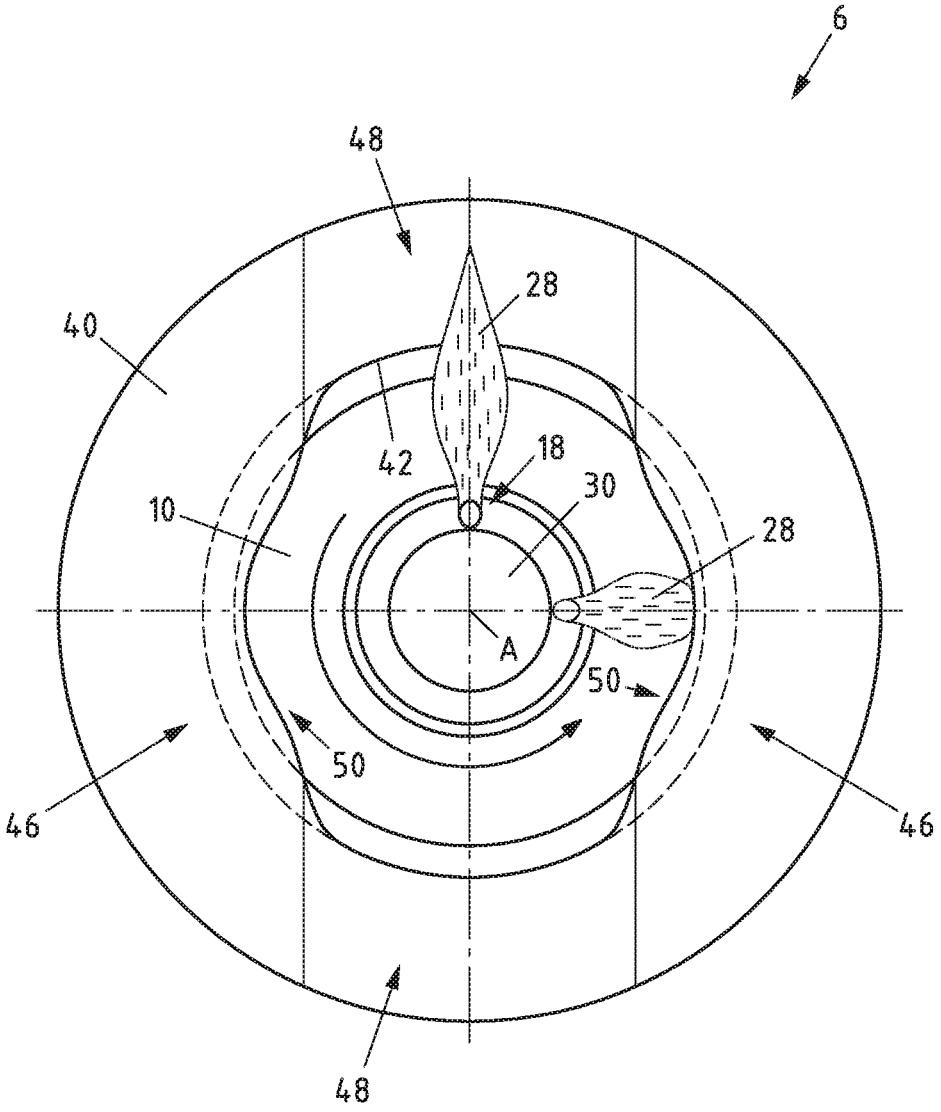

FIGS. 4*a* to 4*c* show a further exemplary embodiment of a device 6 according to the invention with a device 2. In contrast to the exemplary embodiments illustrated in FIGS. 2 and 3, the nozzle arrangement 30 can be rotated relative to a stationary housing 10. Here, the housing 10 is conically tapered at its discharge end and forms an axial/radial bearing for a conically widened upstream part of the nozzle arrangement 30. In the example shown, the bearing is formed as a magnetic bearing 38. The nozzle arrangement 30 is pressed against the conical bearing surface of the housing 10 by the dynamic pressure of the outflowing air, but is held contact-free in the housing by the magnetic bearing 38 such that on its entire circumference it forms a narrow gap having a width of only approximately 0.1 to 0.2 mm with the housing. The earthing of the mouthpiece 30 is effected by spark discharge across this gap.

The nozzle opening 18 functions as a rotary drive for the nozzle arrangement 30 and is not aligned in the exact radial direction, but has a tangential component, so that an aerodynamic drive is formed by the partly tangentially emanating air together with the plasma beam 28. Alternatively to this, the aerodynamic drive can also be effected by means of blades or fins (not illustrated) arranged inside the nozzle arrangement 30 which are impinged by the air flowing in a swirling manner through the channel 34.

This embodiment of the bearing arrangement and of the drive has the advantage that the rotary drive is simplified in terms of design and the moment of inertia of the rotating masses is limited to a minimum.

In contrast to FIG. 3, the exemplary embodiment according to FIG. 4 is designed in such a way that the variation in the length of the shield 40 does not occur in steps, but constantly at least in sections in a curved form, in particular in the form of a sine function. As a result, there are continuous and hence smoother transitions between the longer sections 46 and the shorter sections 48 and therefore a more uniform variation in the intensity of the plasma beam 28 on the surface to be treated.

In addition, it can be recognised in FIG. 4*a* that in the area of the longer sections 46 the inner surface 42 is oriented inwards in the area of the lower edge 50. The effect of the reflection and deflection of the plasma beam 28 is increased by means of this additional measure which is independent of the formation of the sections 46 and 48 in stepped or continuously varying form.

In FIG. 4*a*, the device is illustrated with an angle of rotation of the nozzle arrangement 30, in which the plasma beam 28 strikes one of the longer sections 46 and hence is reflected and deflected. As a consequence, the intensity of the plasma beam 28 is more strongly spread to the inner space surrounded by the shield 40.

FIG. 4*b* shows the device with a nozzle arrangement 30 rotated by 90° compared to the position illustrated in FIG. 4*a*. In this position the plasma beam 28 is directed in the direction of one of the shorter sections 48 and is therefore not or only marginally influenced by the shield 40.

FIG. 4*c* shows the device 2 in a view from below, from which the symmetrical design of the shield emerges. The different illustrated forms of the plasma beam 28 are intended to make clear that the plasma beam 28 depending on the angle of the inner surface 42 is influenced more strongly in the area of the longer section 46 than is the case in the area of the shorter section 48. Hence, the result again is an intensity of the interaction of the plasma beam 28 with the surface of the workpiece which varies in the azimuthal direction.

Figure 5A:
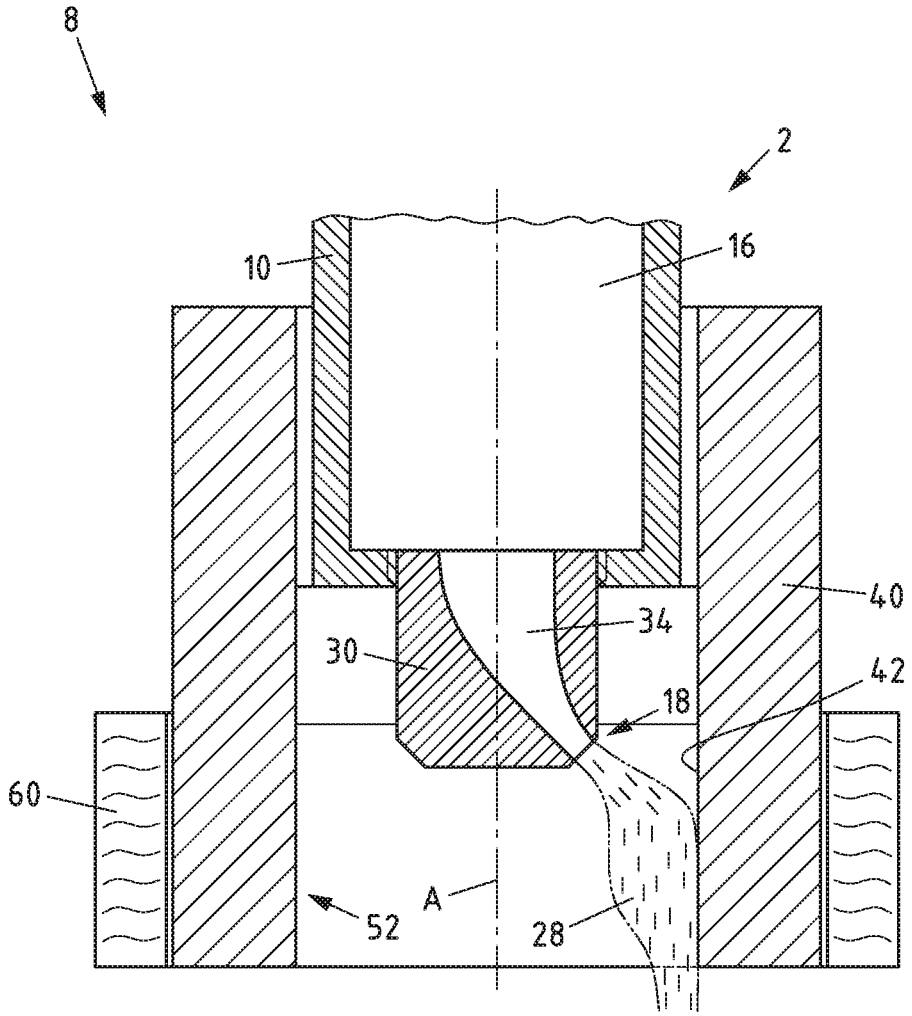
FIGS. 5*a-c* show a third exemplary embodiment of a device according to the invention for generating a plasma beam, FIGS. 6*a,b* show a fourth exemplary embodiment of a device according to the invention for generating a plasma beam, FIGS. 7*a,b* show a fifth exemplary embodiment of a device according to the invention for generating a plasma beam, FIGS. 8*a,b* show a sixth exemplary embodiment of a device according to the invention for generating a plasma beam, FIGS. 9*a,b* show a first exemplary embodiment of an apparatus according to the invention for generating a plasma beam and FIGS. 10*a,b* show a first exemplary embodiment of an apparatus according to the invention for generating a plasma beam.
Figure 5B:
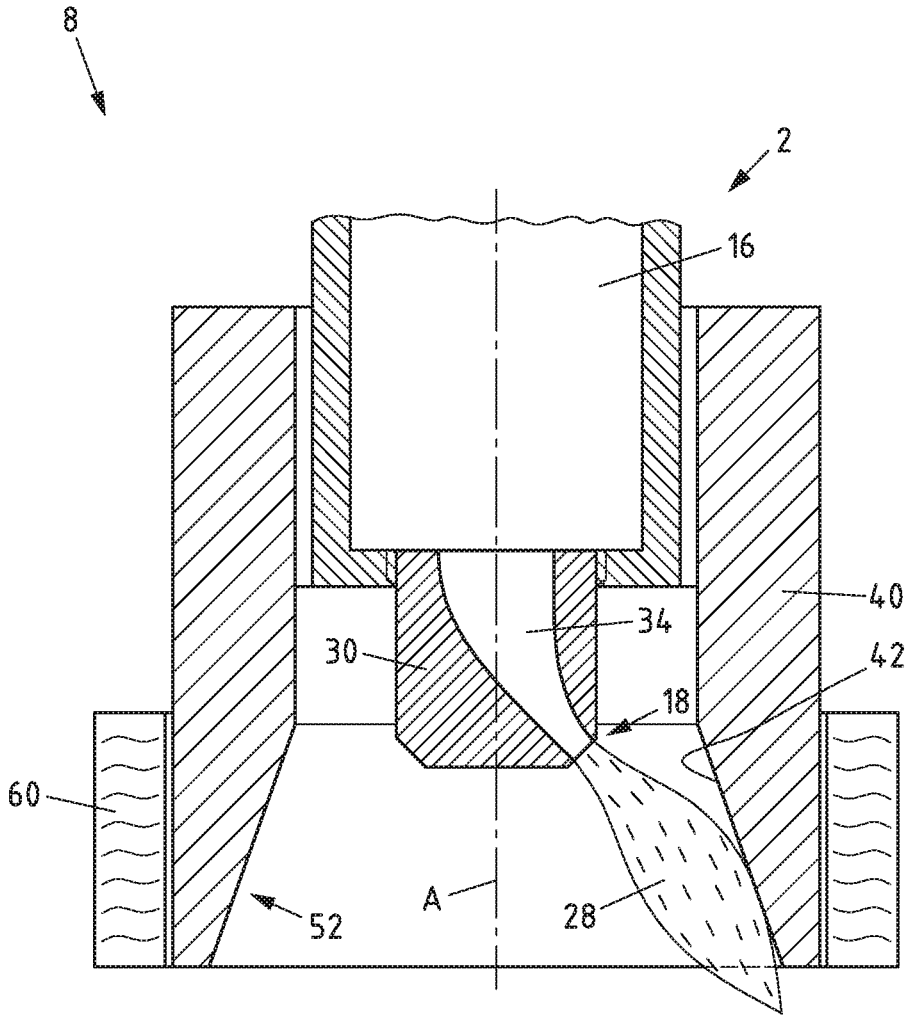
Figure 5C:
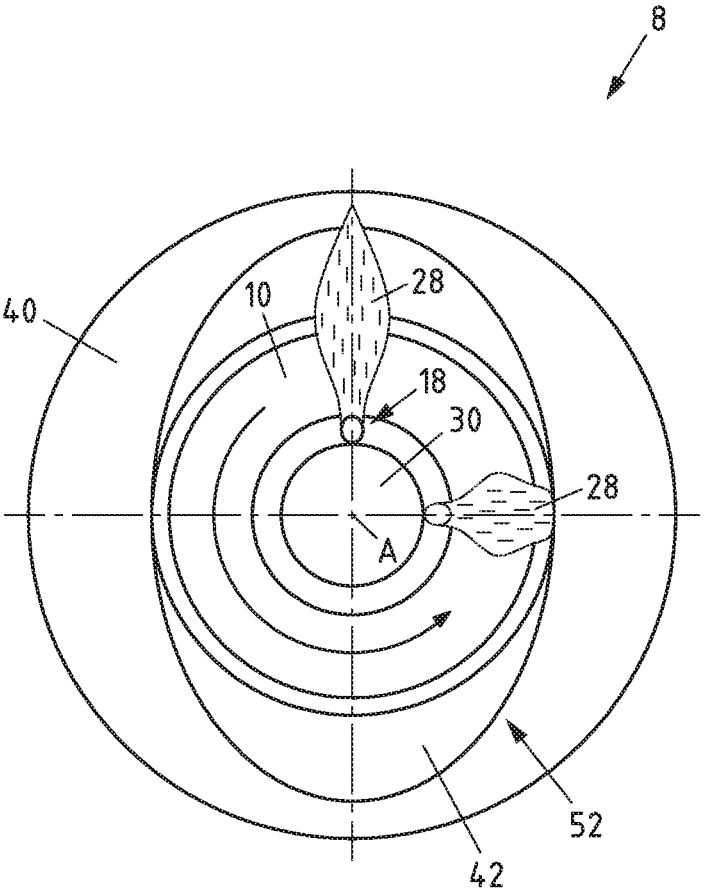

FIGS. 5*a* to 5*c* show a further preferred exemplary embodiment of a device 8 according to the invention for generating an atmospheric plasma beam for treating the surface of a workpiece which also has a device 2 and a shield 40.

According to FIG. 5*a*, the inner surface 42 of the shield 40 in the area of the distal edge 52 has an azimuthally varying angle relative to the axis A, wherein the emanating plasma beam 28 strikes the section 52 which essentially has an inner surface 42 running parallel to the axis A. In this way, the plasma beam, as has already previously been described for the other exemplary embodiments, is reflected and deflected, so that the intensity of the plasma beam 28 is more strongly directed towards the interior of the shield 40.

FIG. 5*b* shows the device 8 in an angular position of the nozzle arrangement 30 which is rotated by 90° compared to the position illustrated in FIG. 5*a*, so that the inner surface 42 is directed outwards in the area 52. The shield 40 therefore widens the interior of the shield in this angular position. In the illustrated position, the plasma beam 28 emanating from the nozzle arrangement 30 only strikes the area 52 of the shield 40 to a minor degree and therefore remains almost unaffected.

FIG. 5c shows the previously described device 8 in a view from below, in which the two different angular positions of FIGS. 5a and 5b are illustrated. The different illustrated forms of the plasma beam 28 are intended to make clear that the plasma beam 28 depending on the angle of the inner surface 42 is influenced varyingly strongly in the area of the of the lower area 52. Hence, the result is an intensity of the interaction of the plasma beam 28 with the surface of the workpiece which varies in the azimuthal direction.

Previously, exemplary embodiments were explained with shields 40 in which either sections 46 and 48 of different lengths or sections of the inner surface 42 are formed at different angles relative to the axis A. However, it is also possible, within the scope of the invention, to have exemplary embodiments, in which sections of different lengths are combined with inner surfaces at different angles relative to the axis A.

The previously explained exemplary embodiments of the devices 4, 6 and 8 according to the invention produce an intensity profile of the plasma treatment of a surface which is changed or is changeable in the azimuthal direction. This intensity profile can be applied in the stationary state, i.e. when the device 4, 6 or 8 is not being moved with respect to the surface to be treated, at certain positions on the surface depending on the application. If, for example, a limited, for example cross-shaped, surface section of the surface is to be treated with plasma, then it is possible within the scope of the invention to design the shield 40 in the previously described way such that there is a corresponding pattern of the plasma treatment below the shield 40 when the nozzle arrangement 30 rotates about the axis 40.

With each of the previously described embodiments of the device 4, 6 or 8 according to FIGS. 3 to 5 a method according to the invention for treating the surface of a workpiece can also be carried out as follows. A plasma beam 28 rotating about the axis A is generated by means of a device 4,6 or 8 generating an atmospheric plasma beam, the device having an axis A and a nozzle arrangement 30 rotating relatively about the axis A. The device 4, 6 or 8 with the rotating plasma beam 28 is moved along the surface to be treated and, by means of a shield 40 having sections 46 and 48 or 50 or 52, the intensity of the interaction of the plasma beam 28 with the surface of the workpiece is changed depending on the angle of rotation of the nozzle arrangement relative to the axis A.

Hence, a certain intensity profile can be set with the plasma treatment of the surface, so that, for example, either an intensity profile is obtained which is as homogeneous as possible or a profile which is known in the prior art, in particular a strip profile in which the intensity of the plasma treatment is increased.

Preferably, the previously described method is carried out in such a way that the rotating plasma beam 28 is shielded by the shield 40 more strongly longitudinally to the direction of movement than transverse to the direction of movement, in particular is reflected or deflected inwards, respectively. Relating to the above described exemplary embodiments, this means that the direction of movement in FIGS. 3a, 4a and 5a is aligned upwards or downwards perpendicular to the plane of projection. In FIGS. 3c, 4c and 5c this direction runs horizontally to the right or left.

In the areas in which otherwise an uninfluenced plasma beam 28 would strike the surface a less intensive treatment of the surface is obtained by means of this method. This is because the plasma beam 28 is reflected and deflected by the shield 40 and thereby distributed within the volume surrounded by the shield 40, whereby the intensity of the plasma beam 28 per surface unit is overall reduced. On the other hand, the plasma beam 28 strikes the surface almost unimpeded in the direction of movement in each case and can achieve a higher intensity of the pre-treatment per surface unit. In this way, an intensity distribution according to FIG. 1c can be obtained.

In addition, FIGS. 5a and 5b show that a heating device 60 for heating the shield 40 is provided. In the present case, the heating device 60 is formed as an electrically heated cylinder which heats up the shield by means of intrinsic temperature and heat radiation. Hence, a loss of energy from the plasma beam 28 striking the shield is reduced or even minimised. In the most general sense, the heating element can also, independent of an azimuthally varying shield, be used for rotationally symmetrical shields.

FIG. 6 shows an exemplary embodiment of a device 2 according to the invention for generating an atmospheric plasma beam for treating the surface of a workpiece, as was described, for example, in connection with FIG. 3. The illustrated shield 40 therefore has an azimuthal design which enables the intensity of the interaction of the plasma beam 28 with the surface of the workpiece to be changed depending on the angle of rotation of the nozzle arrangement 30 relative to the axis A by means of a varying length.

Figure 6A:
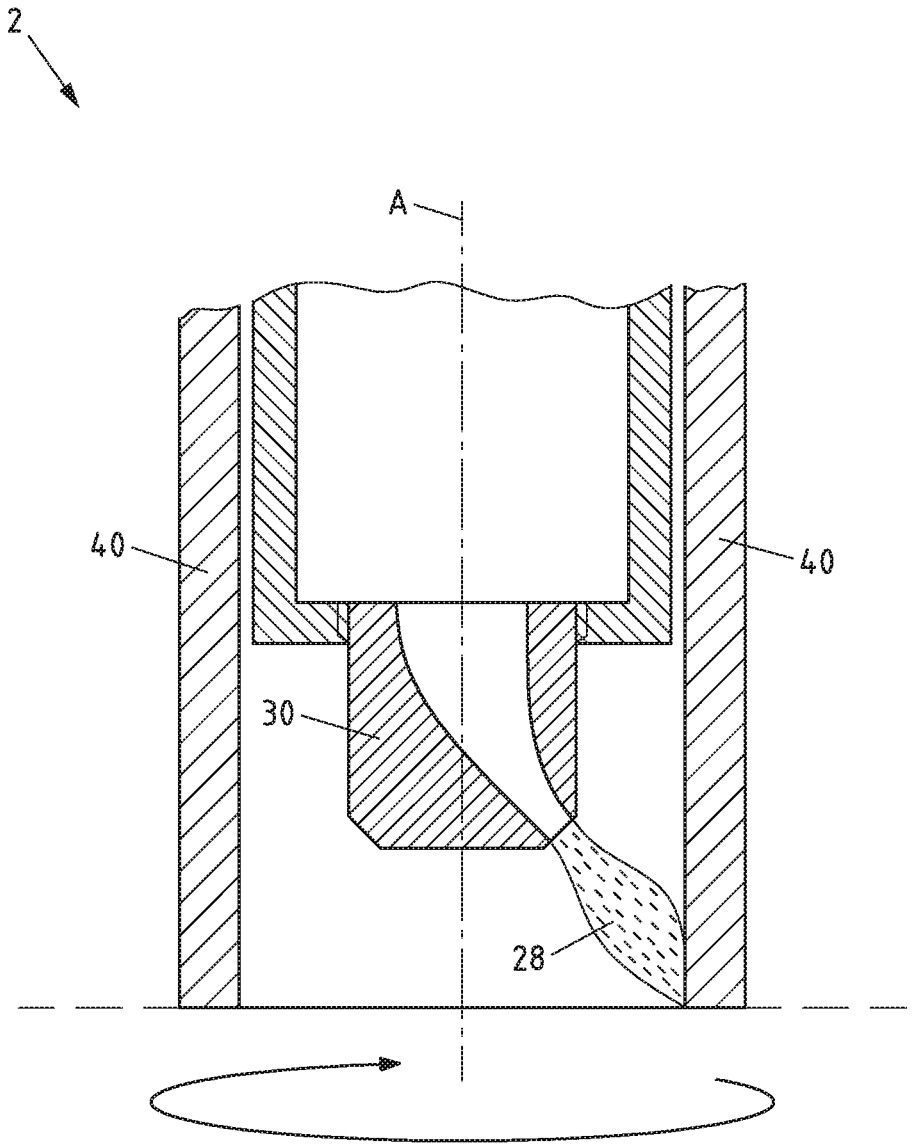
Figure 6B:
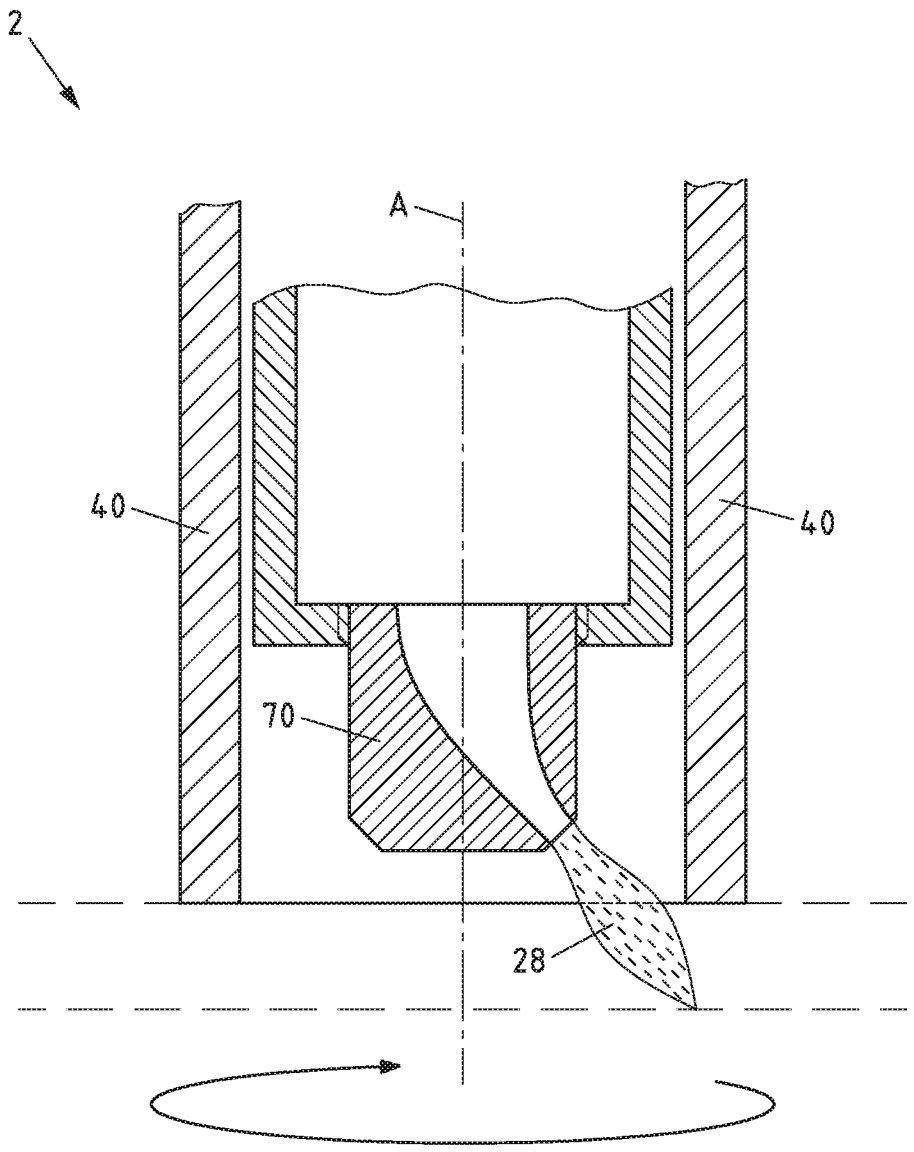

In the exemplary embodiment illustrated in FIGS. 6a and b, the shield 40 is designed to be adjustable in its position relative to the nozzle arrangement 30 in the direction of the axis A. FIG. 6a shows an arrangement of the shield 40 with an axially advanced position, i.e. with a greater distance between the lower edge of the shield 40 and the nozzle arrangement 30 than is shown in FIG. 6b. The shield in FIG. 6b is arranged retracted relative to the lower edge of the nozzle arrangement 30 and therefore influences the emanating plasma beam 28 to a lesser extent than in the position according to FIG. 6a.

Figure 7A:
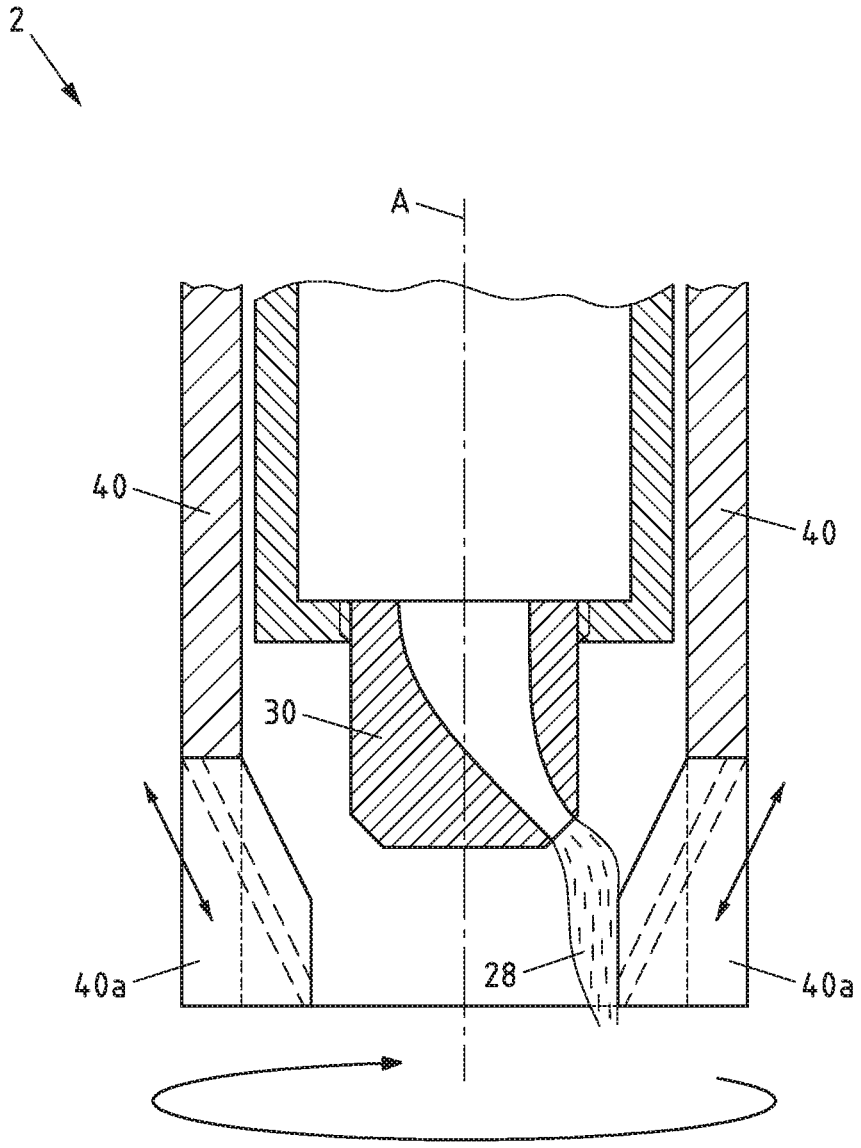
Figure 7B:
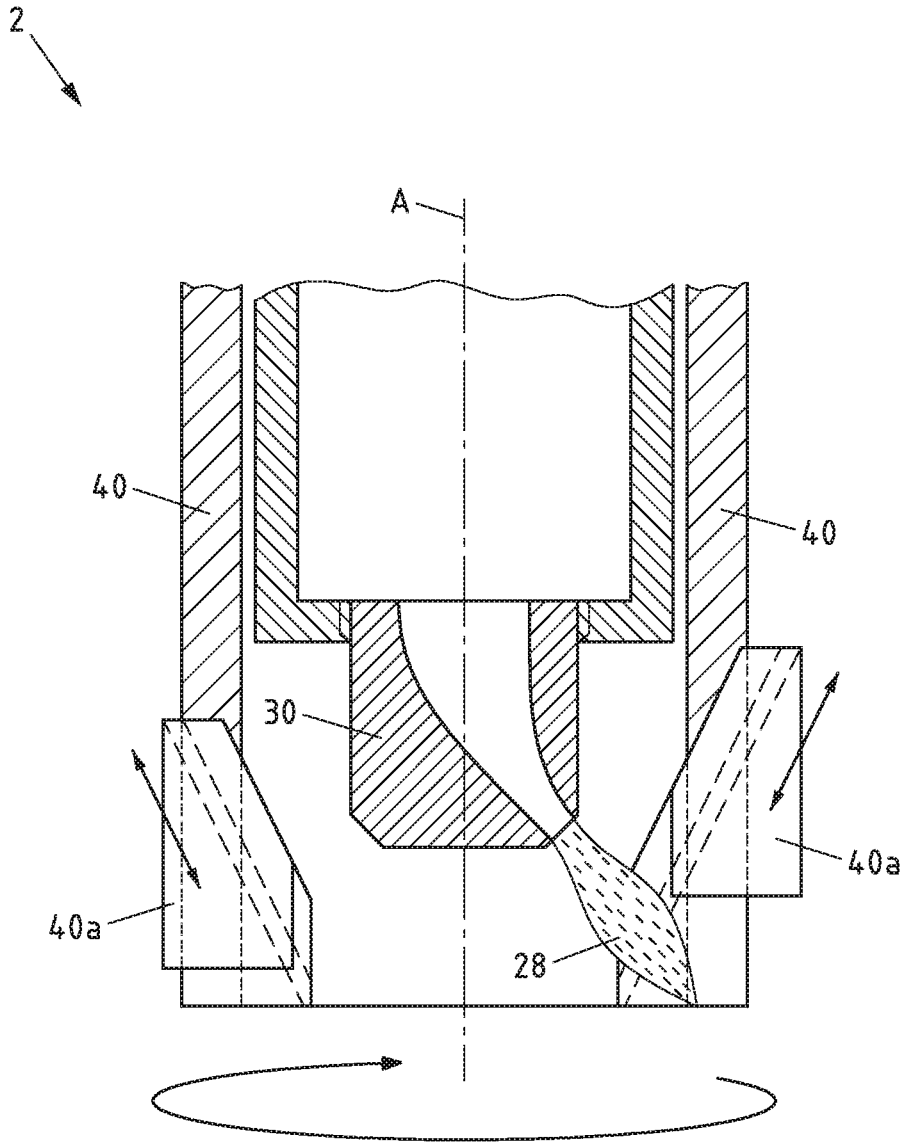

FIGS. 7a and 7b show a further exemplary embodiment of a device 2 according to the invention for generating an atmospheric plasma beam for treating the surface of a workpiece, as was described, for example, in connection with FIG. 3. The illustrated shield 40 has several, but at least two, shield elements 40a, 40b at the lower end and these are designed to be adjustable independently of one another. The shield elements 40a and 40b can be both axially and radially adjusted along a direction running at an angle relative to the axis A. For this purpose, the shield elements 40a and 40b are arranged in guides (not illustrated) and can be fixed in one of a plurality of positions. A specific azimuthal distribution of the influencing of the plasma beam 28 can therefore be set by the plurality of peripheral shield elements 40a, 40b.

Figure 8A:
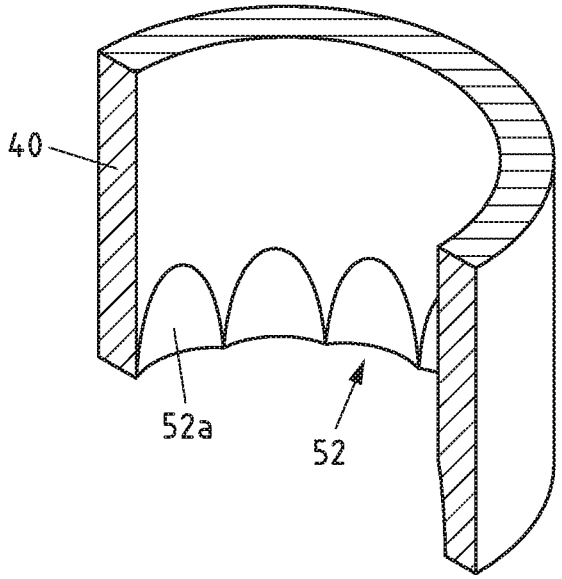

FIG. 8a shows a shield 40 of a further exemplary embodiment of a device 2 according to the invention for generating an atmospheric plasma beam for treating the surface of a workpiece, as was principally described in connection with FIG. 5. In this embodiment, the lower edge of the shield 40 is provided with a plurality of individual recesses 52a of the distal edge 52.

Figure 8B:
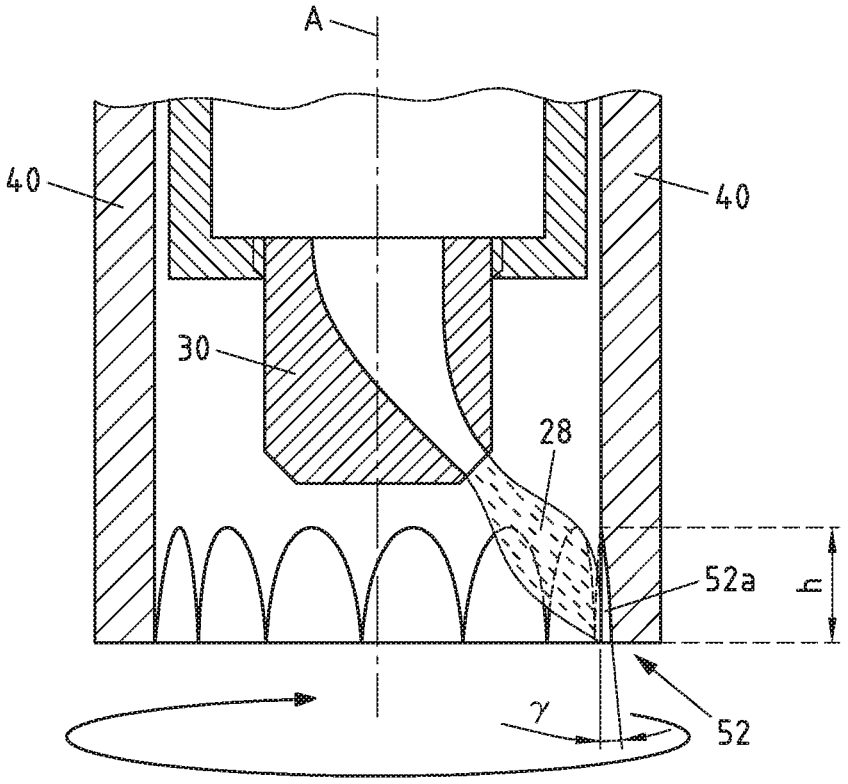

FIG. 8b shows a partial cross-section of the device 2, wherein the lower edge 52 with the recesses 52a forms an azimuthally circumferential pattern of sections with a stronger or weaker influence on the plasma beam 28. By appropriately choosing the individual angles γ and heights h of the recesses 52*a*, a specific angular distribution of the intensity of the plasma treatment of the surface can be achieved.

Figure 9A:
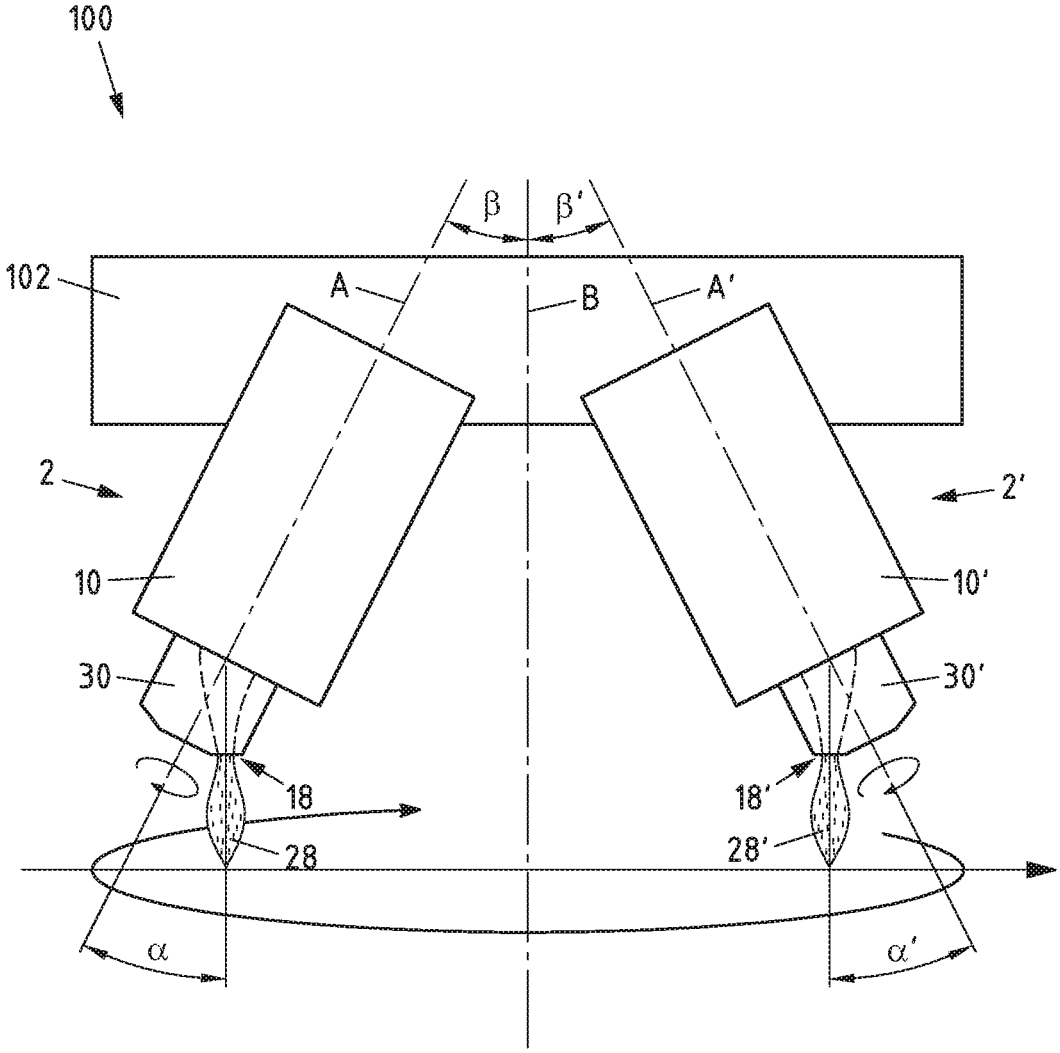
Figure 9B:
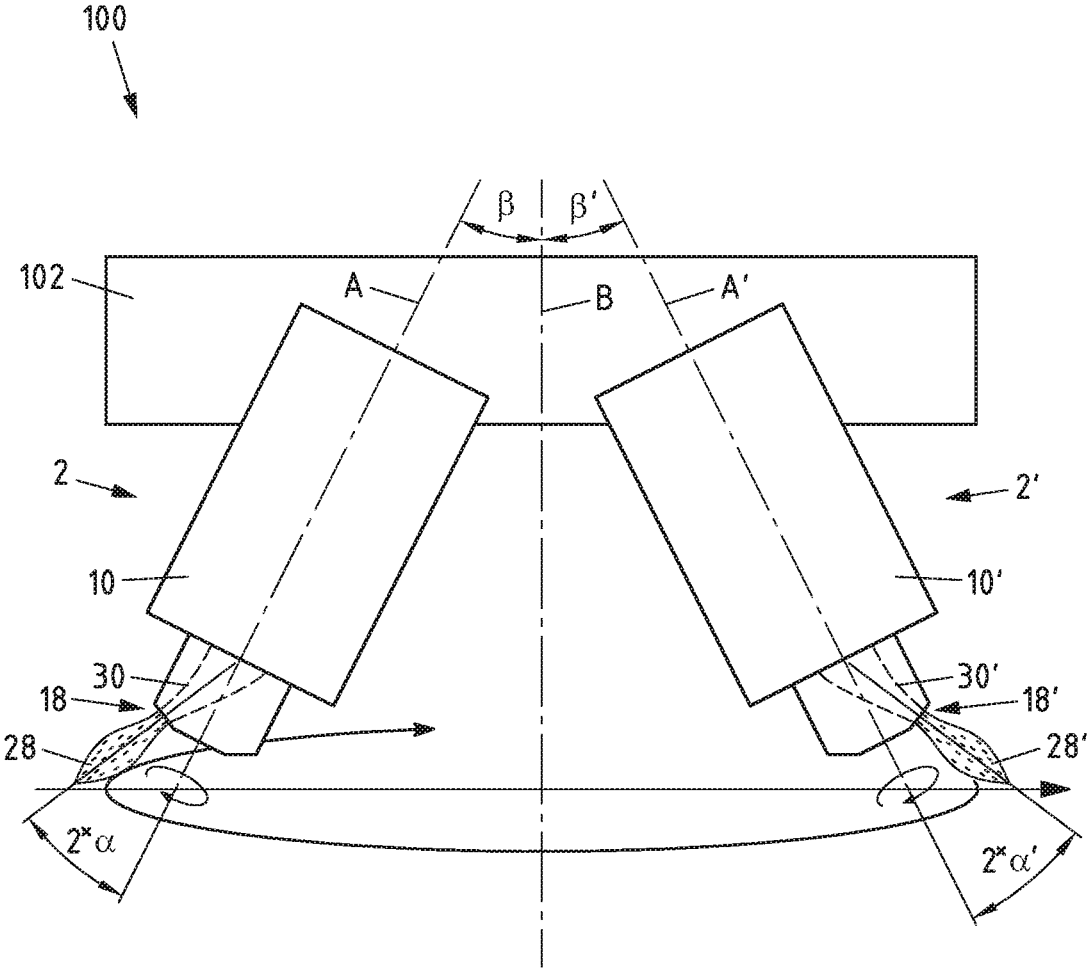

An apparatus 100 according to the invention for treating a surface with atmospheric plasma is illustrated in FIGS. 9*a* and 9*b*. The apparatus 100 has two schematically illustrated devices 2 and 2' for generating an atmospheric plasma beam 28 and 28', as are known for example from the prior art and were explained above with the aid of FIG. 2.

Each of the two devices 2, 2' has a tubular housing 10, 10' with an axis A or A', an inner electrode (not illustrated) arranged inside the housing 10, 10' and a nozzle arrangement 30, 30' having a nozzle opening 18, 18' for discharging a plasma beam 28, 28' to be generated in the housing 10, 10'. Both devices 2, 2' are connected together rotatable about a common axis B by means of a frame 102, wherein in the frame a drive (not illustrated) is provided for generating a rotational movement of the devices 2, 2' about the axis B. The compressed-air connections and voltage connections are arranged in the frame 102 and are not illustrated in detail.

The direction of the nozzle openings 18, 18' in each case runs at an angle α, α' relative to the axis A. A', wherein the nozzle arrangement 30, 30' can be rotated relatively about the axis A, A'. A drive (not illustrated), as was explained with the aid of FIG. 2, is provided in each case for generating a rotational movement of the nozzle arrangements 30, 30' about the respective axis A, A'.

In addition, the two devices 2, 2' are aligned at an angle β, β' relative to the axis B, as FIGS. 9*a* and 9*b* show. The drive for generating a rotational movement of the devices 2, 2' and the drives for generating a rotational movement of the nozzle arrangements 30, 30' are synchronised together in such a way that during one rotation of the devices 2, 2' about the common axis B each of the nozzle arrangements 30, 30' performs two rotations about the respective axis A, A'.

It is preferred and illustrated in FIGS. 9*a* and 9*b* if the angle α, α' of the nozzle openings relative to the respective axis A or A' essentially coincides with the angle β, β' of the devices 2, 2' relative to the axis B. An angular arrangement is thereby obtained, in which in two azimuthally opposing angular positions of the devices 2, 2' the plasma beams 28, 28' are aligned essentially perpendicular to the surface (see FIG. 9*a*), while in two angular positions rotated about 90° and 270° respectively thereto the plasma beams 28, 28' are essentially aligned at an angle of 2*α, 2*α' relative to the surface, i.e. flatter (see FIG. 9*b*). The intensity of the plasma treatment of the surface thus varies twofold between a maximum and a minimum intensity during a rotation of the devices 2, 2' about the common axis B.

A possibility of synchronising the rotational movement of the apparatus together consists in transferring the rotational movement of the nozzle arrangements 30, 30' via a planetary gear, which is arranged in the frame 102 and not illustrated in more detail, by the rotational movement of the devices 2, 2' about the axis B. A further possibility consists in electronically synchronising the respective drives together. In this case, the mechanical effort of a planetary gear is avoided.

A further method for treating the surface of a workpiece can be carried out by a previously described apparatus, in which two rotating plasma beams are generated, in which the apparatus with the rotating plasma beams is moved along the surface to be treated, and in which the plasma beams are directed in two first angular positions 0°, 180° of the rotational movement about the axis B at a steep, preferably perpendicular, angle onto the surface of the workpiece (see FIG. 9*a*), and in which the plasma beams are directed in two second angular positions 90°, 270° of the rotational movement about the axis B at a flat angle, preferably at an angle which is double the angle of the nozzle openings relative to the axes A, A', onto the surface of the workpiece (see FIG. 9*b*).

The previously explained method can be carried out statically in that only one partial area of the surface is treated with the plasma beams 28, 28'.

In a further embodiment of the invention, the apparatus is essentially moved in the direction of one of the two first angular positions 0°, 180° of the rotational movement about the axis B along the surface. Hence, seen in the direction of movement, when the two plasma beams 28, 28' have an alignment which is essentially in the direction of movement, the surface is more intensively treated with plasma than in the angular positions which are adopted transverse to the direction of movement. Hence, an intensity distribution can be achieved according to FIG. 1*c* by the described method and the described apparatus.

Figure 10A:
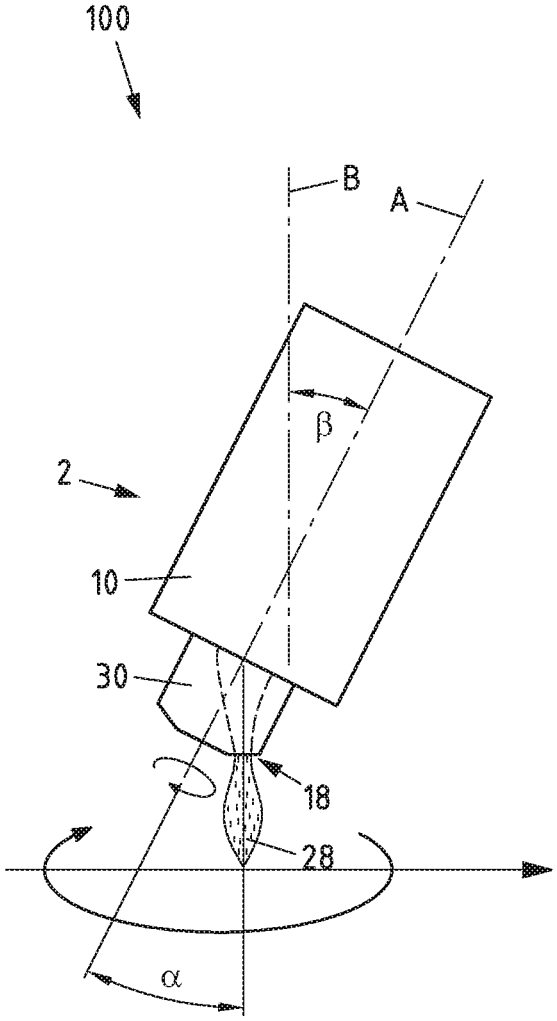
Figure 10B:
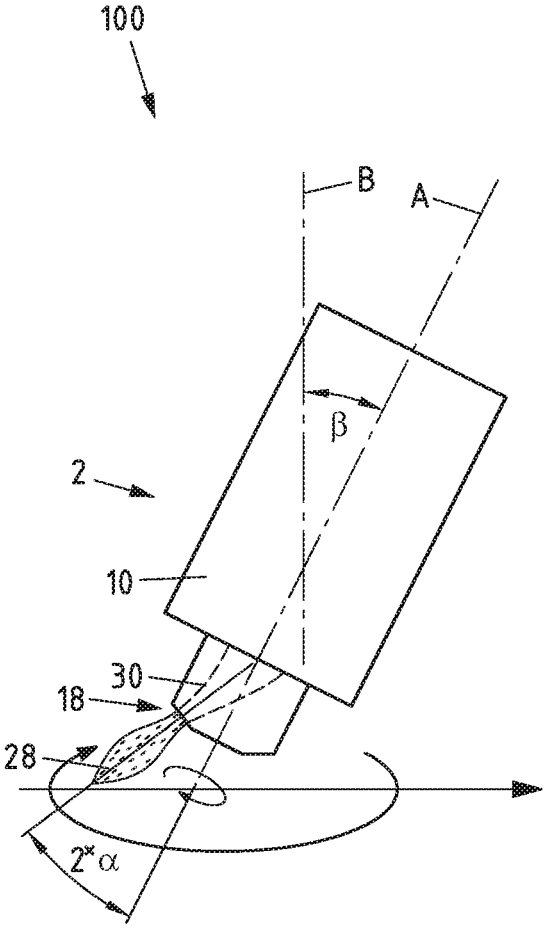

FIG. 10 now shows an exemplary embodiment with only one device 2, in which the axis B essentially runs close to the centre of gravity of the device 2. During the rotation about the axis B, the device 2 performs a wobbling motion which is produced by a drive (not shown). The alignment of the single plasma beam 28 then performs a similar azimuthal directional distribution, as has been previously explained with the aid of FIGS. 6*a* and 6*b* for the devices 2 and 2'. In contrast to the embodiment according to FIG. 6, the diameter of the area treated with plasma by the apparatus is smaller.

The invention claimed is:

1. A device for generating an atmospheric plasma beam for treating a surface of a workpiece, comprising:

a tubular housing which has an axis;

an inner electrode arranged within the housing; and a nozzle arrangement which has a nozzle opening for discharging a plasma beam to be generated in the housing, wherein a direction of the opening runs at an angle relative to the axis, wherein the nozzle arrangement is rotatable relatively about the axis, wherein a shield includes a body that laterally surrounds the nozzle arrangement such that the body is positioned to create an angle-dependent interaction with the nozzle arrangement, and wherein the body is configured to change an intensity of an interaction of the plasma beam to be generated with the surface of the workpiece depending on the angle of rotation of the nozzle arrangement relative to the axis.

2. The device according to claim 1, wherein the shield is formed over only a partial section in the azimuthal direction.

3. The device according to claim 1, wherein the shield is formed over two partial sections symmetrically to the axis in the azimuthal direction.

4. The device according to claim 1, wherein the axial length of the shield varies in the azimuthal direction.

5. The device according to claim 4, wherein the variation in the length of the shield occurs in steps or continuously.

6. The device according to claim 1, wherein an inner surface of the shield, at least in an area of a distal edge, has an azimuthally varying angle relative to the axis.

7. The device according to claim 1, wherein the shield is designed to be adjustable in its position relative to the nozzle arrangement in the direction of the axis, in the radial direction, or in the direction of the axis and in the radial direction.

8. The device according to claim 7, wherein the body of the shield has at least two shield elements which are designed to be adjustable independently of one another, wherein the shield elements are provided for changing the intensity of the interaction of the plasma beam to be generated with the surface of the workpiece depending on the angle of rotation of the nozzle arrangement relative to the axis.

9. The device according to claim 1, wherein a heating device is provided for heating the shield.

10. A method for treating a surface of a workpiece, comprising:

generating a plasma beam rotating about an axis by means of a device generating an atmospheric plasma beam, the device having an axis and having a nozzle arrangement rotating relatively about the axis, moving the device with the rotating plasma beam along the surface to be treated, and changing an intensity of an interaction of the plasma beam with the surface of the workpiece depending on the angle of rotation of the nozzle arrangement relative to the axis by means of a shield.

11. The method according to claim 10, wherein the rotating plasma beam is shielded by the shield more strongly parallel to a direction of movement than transversely to the direction of movement.

* * * * *